US007075505B2

(12) United States Patent
Sakaguchi et al.

(10) Patent No.: US 7,075,505 B2
(45) Date of Patent: Jul. 11, 2006

(54) LIQUID CRYSTAL DISPLAY DEVICE, LIQUID CRYSTAL CONTROLLER AND VIDEO SIGNAL TRANSMISSION METHOD

(75) Inventors: Yoshitami Sakaguchi, Fujisawa (JP); Simon Desgrez, Toulouse (FR)

(73) Assignee: AU Optronics Corporation (TW)

( * ) Notice: Subject to any disclaimer, the term of this patent is extended or adjusted under 35 U.S.C. 154(b) by 221 days.

(21) Appl. No.: 09/733,673

(22) Filed: Dec. 8, 2000

(65) Prior Publication Data

US 2001/0013850 A1 Aug. 16, 2001

(30) Foreign Application Priority Data

Dec. 10, 1999 (JP) ..... 11-351784

(51) Int. Cl.
*G09G 3/36* (2006.01)

(52) U.S. Cl. ..... 345/87; 345/88; 345/89; 345/90; 345/98; 345/206

(58) Field of Classification Search ..... 345/87, 345/88–89, 92, 90, 98, 206, 690, 50, 51, 345/55; 327/94–96, 100, 427
See application file for complete search history.

(56) References Cited

U.S. PATENT DOCUMENTS 5,021,775 A * 6/1991 Babin ..... 345/213
5,148,263 A * 9/1992 Hamai ..... 257/758
5,513,115 A * 4/1996 Richards et al. ..... 700/200
5,623,519 A * 4/1997 Babcock et al. ..... 340/14.1
5,642,136 A * 6/1997 Jayavant et al. ..... 345/467
5,751,261 A * 5/1998 Zavracky et al. ..... 345/55
5,768,174 A * 6/1998 Seo et al. ..... 365/63
5,801,674 A * 9/1998 Shimizu ..... 345/103
5,825,777 A * 10/1998 Komarek et al. ..... 370/458
5,974,464 A * 10/1999 Shin et al. ..... 341/58
6,049,318 A * 4/2000 Ota ..... 345/93
6,211,849 B1 * 4/2001 Sasaki et al. ..... 345/55
6,232,940 B1 * 5/2001 Ohno et al. ..... 345/103
6,232,946 B1 * 5/2001 Brownlow et al. ..... 345/100
6,262,704 B1 * 7/2001 Kurumisawa et al. ..... 345/100
6,310,596 B1 * 10/2001 Takasugi ..... 345/566
6,335,720 B1 * 1/2002 Mori et al. ..... 345/100
6,335,778 B1 * 1/2002 Kubota et al. ..... 349/151

(Continued)

FOREIGN PATENT DOCUMENTS

JP 09-044100 * 2/1997

*Primary Examiner*—Bipin Shalwala
*Assistant Examiner*—Leonid Shapiro
(74) *Attorney, Agent, or Firm*—Scully, Scott, Murphy & Pressor

(57) ABSTRACT

It is one object of the present invention to reduce the number of inputs to an LCD driver and to reduce manufacturing costs by employing the COG&WOA technique.

For a liquid crystal display device, source driver ICs 20, among which video signals are transmitted and distributed via a video I/F 3, are cascade-connected, and the connection lines to the source driver ICs 20 are reduced as much as possible to employ the COG&WOA technique. That is, a liquid crystal display device comprises: a liquid crystal cell 2, which forms an image display area on a substrate, and a source driver 7, which applies a voltage to the liquid crystal cell 2 based on a video signal input via a video I/F 3. The source driver 7 includes a plurality of source driver ICs 20 that are mounted on the same substrate as the liquid crystal cell 2 and that are cascade-connected by signal lines.

13 Claims, 19 Drawing Sheets

U.S. PATENT DOCUMENTS 6,360,291 B1 * 3/2002 Tavallaei ..... 710/306
6,407,730 B1 * 6/2002 Hori ..... 345/100
6,593,918 B1 * 7/2003 Taguchi et al. ..... 345/204
6,658,661 B1 * 12/2003 Arsenault et al. ..... 725/54

* cited by examiner

FIG. 4

| | 41 | 42 |
|---|---|---|
| BIT BLOCK FORMAT | HEADER 4BIT | DATA 24BIT |
| (1) SYNCHRONIZATION BIT BLOCK 44 | SYNC [1000] | ALL ZERO [000000000000000000000000] |
| (2) COMMAND BIT BLOCK 45 | COMMAND [1100] | COMMAND BITS 24BIT |
| (3) DATA BIT BLOCK 46 | DATA [1110] | DATA BITS 24BIT |
| (4) WAIT BIT BLOCK 47 | WAIT [1111] | UNDEFINED 24BIT |

INITIAL SETUP

FIG. 8

| 4-BIT LATCH (n CLOCK) [A3, A2, A1, A0] | SELECTOR (n+1 CLOCK) [D3, D2, D1, D0] | CONTROL ID |
|---|---|---|
| [1, 0, 0, 0] | [A2, A1, A0, B3] | 0 |
| [0, 1, 0, 0] | [A1, A0, B3, B2] | 1 |
| [0, 0, 1, 0] | [A0, B3, B2, B1] | 2 |
| [0, 0, 0, 1] | [B3, B2, B1, B0] | 3 |

FIG. 9

| BIT BLOCK TYPE | COMPARISON PATTERN WITH SELECTOR OUTPUT [D3, D2, D1, D0] |
|---|---|
| SYNCHRONIZATION | [0, 0, 0, 1] |
| COMMAND | [0, 0, 1, 1] |
| DATA | [0, 1, 1, 1] |
| WAIT | [1, 1, 1, 1] |

Sin
0
DATA0
1 1 1 0 0 0

LIQUID CRYSTAL DISPLAY DEVICE, LIQUID CRYSTAL CONTROLLER AND VIDEO SIGNAL TRANSMISSION METHOD

BACKGROUND OF THE INVENTION

1. Technical Field

The present invention relates to a liquid crystal display device for displaying an image based on a received video signal, and relates in particular to a liquid crystal display device provided with an improved driver interface for a liquid crystal display panel.

2. Prior Art

Generally, when displaying an image on a liquid crystal display panel, first, an image signal from the graphics controller of a system, including a PC, or of a system unit is output via a video interface. Then, upon receiving the image signal, an LCD (liquid crystal display) controller LSI transmits a signal to each of the individual ICs in a source driver (an X driver or an LCD driver) and a gate driver (a Y driver), and applies a voltage to each source electrode and each gate electrode in a TFT array, arranged as a matrix, until finally, an image is displayed.

An interface used by a conventional LCD driver is shown in FIG. 20. In FIG. 20, one constituent of a source driver is an IC chip 301, fewer than twenty of which are provided for one LCD panel. As is commonly done with the chip on glass (COG) technique, the chips 301 are mounted on a glass substrate, which constitutes the LCD panel, outside an area covered by a color filter. Each of the chips 301 is then connected to a power feed line (Power) 302, and each of them receives a video interface signal 303 and a sampling start signal (StartPulse) 304. In consonance with a gray scale of 8 bits, provided for the video interface signal 303 and the sampling start signal 304 are a total of 28 lines, 27 of which are used for the video interface signal 303 to carry 24 bits of RGB video data, comprising one 8 bit set for each of the three colors R, G and B, a strobe signal for outputting received RGB data to the LCD, a polarity signal for designating the polarity of a voltage that is to be applied to the LCD, and a clock signal for transmitting a dot clock of about 65 MHz when an XGA (1024×768 dots) panel is employed. The sampling start signal 304 is used to initiate the sampling of the RGB video data.

As is shown in FIG. 20, a cascade-connection may be used for the sampling start signal 304. However, the power line 302 and the 27 lines of the video interface signal 303 are arranged on an adjacently and separately provided printed circuit board (PCB) or flexible printed circuit board (FPC). That is, since it is difficult for the conventional technique to provide the wiring between the chips on the glass substrate, a line wiring section is formed on the adjacent printed circuit board so that video data can be transmitted through a bus that connects the chips. In this case, no problem has arisen considering the number of video signals input to the LCD source driver.

Recently, in order to further reduce manufacturing costs, attention has been focused on a COG&WOA (Wiring On Array) technique. In addition, another technique has been developed whereby a driver LSI is arranged on a TCP (Tape Carrier Package) so that the LSI is connected, via the TCP, to a TFT array substrate (a glass substrate). If, using these techniques, the IC can be attached to the glass substrate directly, or via the TCP, and the wiring formed on the printed circuit board can be eliminated, the manufacturing costs can be greatly reduced.

However, with a conventional bus connection, a great number of video signals are input to the LCD source driver, and implementation of a COG&WOA LCD module can not be performed. That is, if multiple lines, such as 28 lines, are to be moved unchanged to the glass substrate, a frame space of 1 to 2 cm is required around a liquid crystal cell. If such a large frame space is provided, this will constitute the provision of a condition that runs counter to current demand, which is for a reduced frame size, and accordingly, the value of the product will be reduced.

As a technique for reducing the frame size by using a COG structure, a wiring arrangement whereby an FPC is so constructed that it covers the chips, and the chips are connected to the FPC is proposed in Japanese Unexamined Patent Publication No. Hei 5-107551. According to this technique, the frame size can be reduced, but the thickness of the panel can not. Further, since in this structure all the chips are connected directly to the FPC, the number of connection terminals is increased, and the reliability of the connections will not be satisfactory. In addition, since multiple FPC connection terminals are provided between the chips, large gaps are required between the chips, and this makes it difficult to reduce the size of the device.

To resolve the above described shortcomings, it is one object of the present invention to drastically reduce the number of video signals that are input to an LCD driver and to reduce the manufacturing costs by implementing the COG&WOA technique.

It is another object of the present invention to provide a structure that can constitute a fast, compact serial interface for low power consumption, and that can minimize the number of fast operating circuits that are used, thereby suppressing an increase in power consumption and an increase in chip size.

SUMMARY OF THE INVENTION

To achieve the above objects, according to the present invention, driver ICs to which an input video signal is distributed are, to the greatest extent possible, cascade-connected to reduce the number of wiring lines leading to the individual drivers IC, so that the COG&WOA structure can be implemented. That is, a liquid crystal display device according to the present invention comprises: a liquid crystal cell which forms an image display area on a substrate; and a driver for applying a voltage to the liquid crystal cell based on an input video signal, wherein the driver includes a plurality of driver ICs that are mounted on the substrate and are cascade-connected using signal lines.

It is preferable that each of the driver ICs include an input pad and an output pad, and that, because the cascade connection can be easily carried out, among these driver ICs the output pad of a first driver IC be connected to the input pad of a second driver IC. Further, when an input pad and an output pad are located at the two ends of each driver IC, the lengths of the signal lines and of the clock lines, or the lengths of paired signal lines along which a differential signal is transmitted, can be easily matched, and the phase adjustment can be easily performed.

Further, the driver includes the plurality of driver ICs that are cascade-connected to a power feed line via metal layer of the each driver ICs. Compared with when a power feed line is provided on the substrate, power can be supplied to the driver IC that is furthest downstream, while a low resistance is maintained.

The driver ICs receive video signal consisting of serial data, and the video signal is synchronized based on a synchronization pattern included in the serial data. The synchronization pattern is transmitted during a horizontal blanking period for a video signal.

Furthermore, it is preferable that a low differential voltage signal be employed for the transmission of a video signal, and that one pair of lines (two lines) be used for video data, while another pair of lines (two lines) is used for a synchronization clock. As a result, a fast serial interface can be efficiently implemented.

According to the present invention, a liquid crystal display device comprises: a liquid crystal cell which forms an image display area on a substrate; and a driver for distributing an input video signal to a plurality of chain-connected driver ICs, and for applying a voltage to the liquid crystal cell by employing the driver ICs, wherein the driver distributes the video signal to the plurality of driver ICs with providing a masking signal from an upstream driver IC to a downstream driver IC of the plurality of driver ICs, wherein the masking signal masks the video signal to be provided by the upstream driver ICs. With this arrangement, only the video signal lines can be employed the for distribution of a video signal. And the masking process can be performed by adding a plurality of (e.g., three) logic gates to a differential buffer.

The downstream driver IC of the driver receives the masking signal from the upstream driver IC, and applies a voltage to the liquid crystal cell in accordance with the input video signal. Then, the downstream driver IC can easily receive a video signal following the receipt of a command to receive succeeding data.

Furthermore, according to the present invention, a liquid crystal display device comprises: a liquid crystal cell which forms an image display area on a substrate; and a driver for distributing an input video signal to a plurality of driver ICs that are cascade-connected, and for applying a voltage to the liquid crystal cell by employing the driver ICs, wherein the driver ICs of the driver are cascade-connected by a video transmission line provided on the substrate, and are controlled by serial data that are transmitted along the video transmission line.

The video transmission line connecting the plurality of driver ICs comprises a first signal line, and a second signal line for which the polarity of the first signal line has been inverted. With this arrangement, during rapid serial transmission, the occurrence of electromagnetic interference (EMI) can be reduced as much as is possible, and the transmission of signals is ensured. A pair of lines, other then the video transmission lines, can also be employed as synchronization clock lines.

The driver further comprises a clock line and a power line which makes a cascade connection to the plurality of driver ICs. The WOA can be implemented by efficient provision of substrate wiring.

In addition, of the driver ICs, an upstream driver IC includes a dummy circuit for substantially matching a video phase and a clock phase. Thus, the phases of the driver ICs that are cascade-connected can be matched without a PLL (Phase Locked Loop) circuit being provided for the synchronization of each driver IC. The phases do not have to be fully matched, and must be matched only within a permissible range.

When the present invention is applied for a controller, a liquid crystal controller comprises: a receiver for receiving a video signal from a host to displaying an image; a sequencer for, upon the receipt of a control signal from the host, generating header information for packet data that are to be output to an LCD driver comprising a plurality of driver ICs which are cascade-connected; and output means for converting the video signal received from the receiver into a serial video signal, for adding the header information generated by the sequencer to the serial video signal, and for outputting the resultant serial video signal to the LCD driver. With this packet transmission, the LCD driver can be controlled simply by using the video transmission line, and the input of a control signal, as in the prior art, is not required.

The sequencer generates the header information by which the driver ICs of the LCD driver are synchronized with each other, and the output means provide the header information used for synchronization during a horizontal blanking period.

Further, according to the present invention, a video signal transmission method for transmitting a video signal to an LCD driver which has a plurality of driver ICs comprises the steps of: transmitting a video signal, including a horizontal blanking period, to the driver ICs via a serial interface; and transmitting a synchronization pattern during the horizontal blanking period in order to synchronize the video signal for the driver ICs.

Further, when the synchronization pattern is transmitted for at least at two cycles, the driver IC can extract the serially transmitted synchronization pattern. Moreover, when during the period in which the video signal is transmitted, the driver ICs conform to the synchronization pattern, even if an erroneous operation is performed the recovery of the synchronization can be accomplished one line later.

According to the present invention, a video signal transmission method, for transmitting a video signal to an LCD driver which has a plurality of driver ICs that are cascade-connected, comprises the steps of: transmitting a video signal via a serial interface to the driver ICs that are cascade-connected; and applying to an LCD a voltage based on the video signal that is received and that is to be processed by each of the driver ICs; wherein the video signal is constituted by bit blocks having a plurality of attributes and wherein said driver ICs are controlled by using the bit blocks.

One of the bit blocks includes a wait command for waiting for the driver ICs. The wait command is generated by each of the driver ICs that processes the video signal, and is transmitted to a downstream driver IC that is cascade-connected. According to this method, a video signal can be distributed using a method whereby the video signal to be processed by the upstream driver IC is not shown to the downstream driver IC. In addition, the video signal line can be used for the distribution of a video signal.

The video signal can be transmitted to the LCD driver by using a packet, and the plurality of driver ICs are controlled by a protocol that employs the header of the packet. Thus, all the driver ICs can be easily controlled without a special control input by the driver IC being required.

BRIEF DESCRIPTION OF THE DRAWINGS

Preferred embodiments of the present invention will now be described, by way of example only, with reference to the accompanying drawings in which:

FIG. 4 is a diagram showing example formats for serial data used for the embodiment.

FIG. 8 is a diagram showing the relationship between a comparison pattern for a header 41 and the output of a selector 54.

FIG. 9 is a diagram showing a pattern for conformation of data synchronization.

DETAILED DESCRIPTION OF THE PREFERRED EMBODIMENTS OF THE INVENTION

Figure 1:
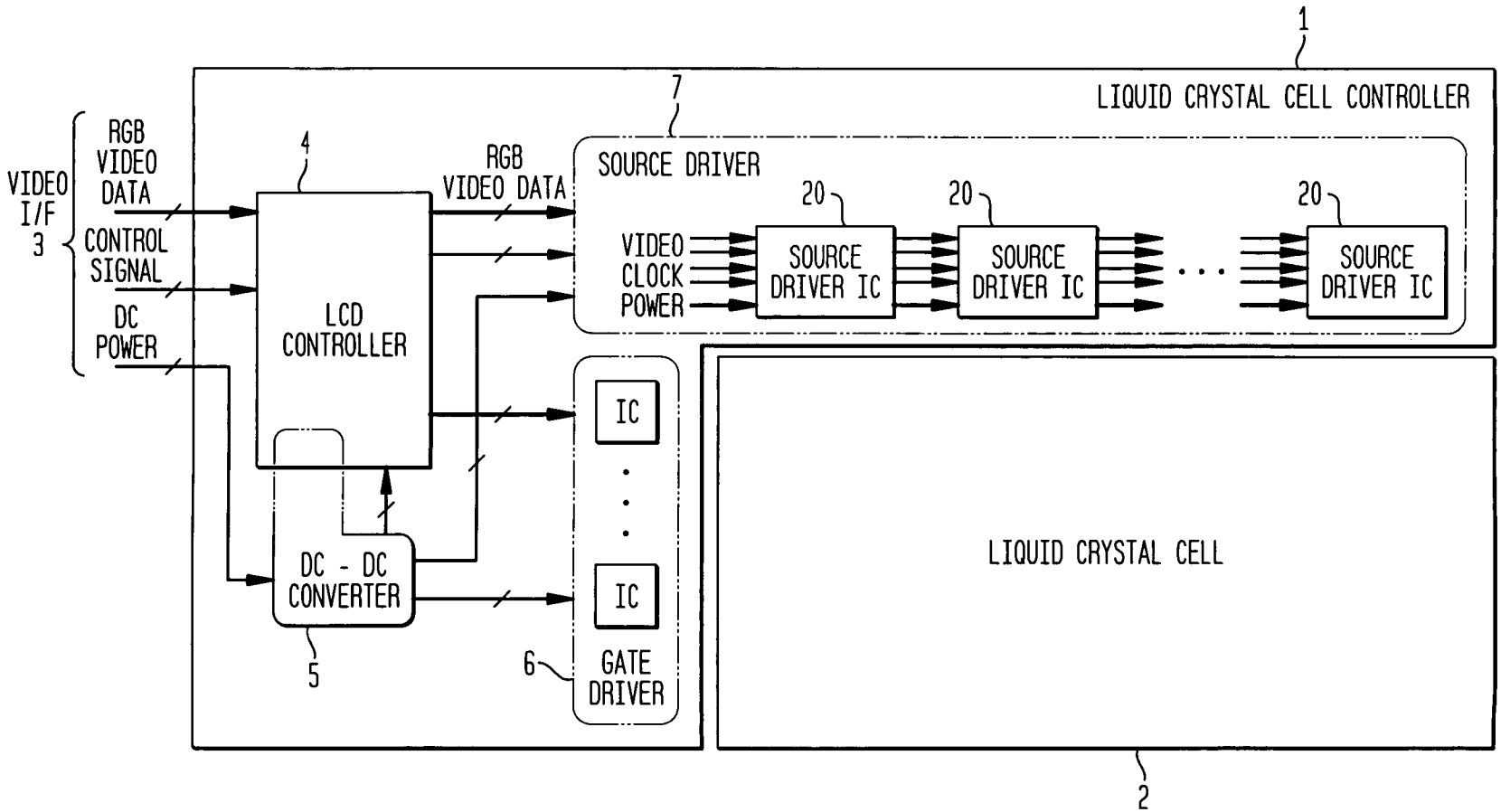
FIG. 1 is a diagram illustrating the arrangement of an image display device according to one embodiment of the present invention.

FIG. 1 is a diagram illustrating the arrangement of an image display device according to one embodiment of the present invention. A liquid crystal cell controller 1 and a liquid crystal cell 2, which has the same liquid crystal structure as does a thin-film transistor (TFT), constitute a liquid crystal module. The liquid crystal module is mounted on a display device that is separated from a host system, or on the display unit of a notebook PC. In the liquid crystal cell controller 1, RGB video data (video signals) or a control signal are transmitted by the graphics controller LSI (not shown), via a video interface (I/F) 3 of the host system, to an LCD controller 4. Further, generally, DC power is supplied via the video I/F 3. A DC—DC converter 5 employs the DC power that is received to generate a DC power voltage required by the liquid crystal cell controller 1, and supplies the voltage to a gate driver 6, a source driver 7, and a backlight fluorescent tube (not shown). The LCD controller 4 processes a signal received from the video I/F 3, and transmits the thus obtained signal to the gate driver 6 and the source driver 7. The source driver 7 outputs a voltage to be applied, in the horizontal direction (the X direction), to the source electrodes of the TFTs that are arranged as a matrix on the liquid crystal cell 2. The gate driver 6 outputs a voltage to be applied to the source electrodes of the TFTs that are arranged in the vertical direction (the Y direction).

The gate driver 6 and the source driver 7 are constituted by a plurality of ICs. In this embodiment, the source driver 7 includes a plurality of source driver ICs 20, which are LSI chips. For the sake of convenience, in the explanation in FIG. 1 the liquid cell controller 1 and the liquid crystal cell 2 are separated. However, in the embodiment, the source driver ICs 20 are formed in accordance with a COG structure on a glass substrate that forms the liquid crystal cell 2, and individual lines are also laid on the glass substrate in accordance with a WOA structure. Further, as a characteristic structure, all the lines for the source driver ICs 20 are cascade-connected (sequentially connected as a continuous connection or a multiple connection). That is, the 28 video interface signals that are conventionally used for driving are replaced by one pair of data signal lines and one pair of clock signal lines, which are to be used for driving. Therefore, only four IO pads must be located at each end of each source driver IC 20. In this embodiment, the power signal is input at the right and left ends of each source driver IC 20, and a power source is also cascade-connected via the metal layer in the chip. With this arrangement, on the glass substrate driver wiring is not required in a portion immediately below each source driver IC 20, and the short ring line that is normally used can be deposited at the pertinent portion in order to protect a TFT.

Figure 2:
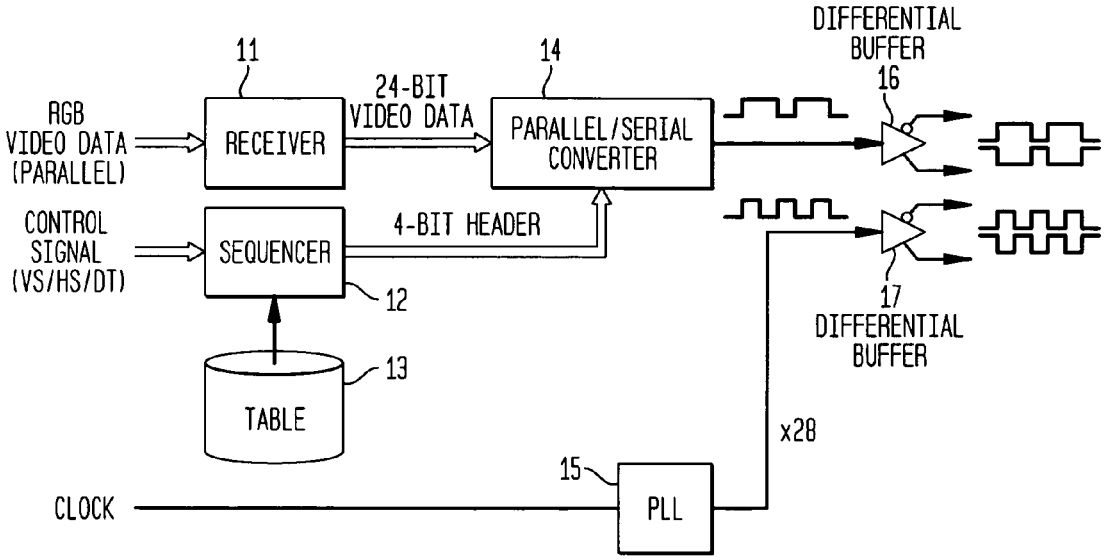
FIG. 2 is a diagram for explaining the internal structure of an LCD controller 4 according to the embodiment.

FIG. 2 is a diagram for explaining the internal structure of the LCD controller 4 according to this embodiment.

A receiver 11 has a function for receiving and latching parallel RGB video data that are input via the video I/F 3 (see FIG. 1). Based on a table 13 in which information is stored to prepare a packet, a sequencer 12 prepares header information for a four-bit packet by employing three control signals, a VS (vertical synchronization signal), an HS (horizontal synchronization signal) and a DT (display timing signal). Specifically, the sequencer prepares a command for controlling the source driver ICs 20, such as the output of "0000" at a blanking period. Further, the sequencer 12 transmits, during the horizontal blanking period, a synchronization signal used for synchronization of the source driver ICs 20. A parallel/serial converter 14 converts, into serial data, the 24-bit parallel video data that are latched and output by the receiver 11 and the 4-bit header information, which is generated by the sequencer 12, and transmits the obtained serial data to a differential buffer 16. A PLL (Phase Locked Loop) circuit 15 prepares a clock that is multiplied 28 times and transmits it to a differential buffer 17. Then, the differential buffers 16 and 17 prepare differential signals by respectively adding to the data, received from the parallel/serial converter 14, and the multiplied clock, received from the PLL circuit 15, similar data having an inverted polarity, and output the differential signals to the source driver ICs 20.

Figure 3:
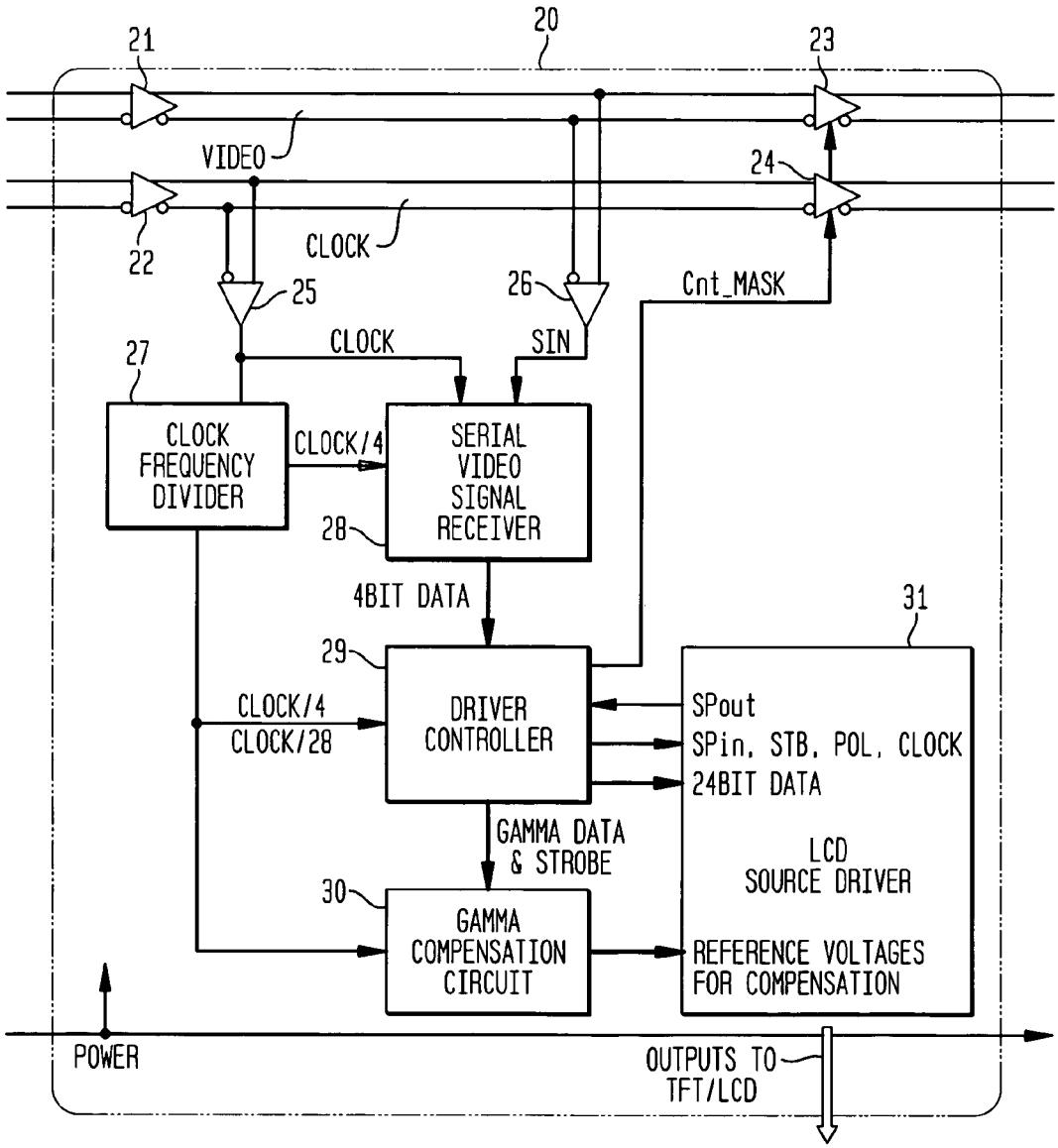
FIG. 3 is a diagram for explaining the internal structure of a source driver IC 20 according to the embodiment.

FIG. 3 is a diagram for explaining the internal structure of the source driver IC 20 according to this embodiment. The source driver IC 20 includes: differential buffers 21 and 22, for receiving differential signals from the LCD controller 4 and a preceding source driver IC 20; differential buffers 23 and 24, for outputting differential signals to a succeeding source driver IC 20; a converter 25, for converting a differential clock signal received from the differential buffer 22 into a single clock; a converter 26, for converting a differential video signal received from the differential buffer 21 into a single video signal (Sin); a clock frequency divider 27, for converting a clock received from the converter 25 into a low synchronized frequency; a serial video signal receiver 28, for employing serial data to generate appropriate 4-bit parallel data; a driver controller 29, for controlling an LCD source driver 31; a gamma compensation circuit 30, for generating a reference gamma compensation voltage; and the LCD source driver 31, for receiving video data and applying a video voltage to the liquid crystal cell 2.

In this embodiment, the values output by the differential buffers 23 and 24 can be forcibly set to "1" by using a control signal Cnt_Mask that is output by the driver controller 29. With this arrangement, video data for a source driver IC 20 can be masked relative to a downstream source driver IC 20, and without any special wiring being required, video data can be distributed among the source driver ICs 20. In order to use a differential clock to operate the individual circuits that constitute the source driver IC 20, the converter 25 performs the same functions as the differential buffers 21 and 22. And while the gamma compensation circuit 30 is not required when a reference gamma compensation voltage is input by an external source, it is preferable that such a voltage be internally generated in order to reduce the number of inputs to the source driver IC 20. Only a plurality of 10-bit precision DACs must be prepared and only gamma compensation data must be downloaded via the interface of this embodiment, and a common LCD source driver can be used as the LCD source driver 31. That is, the output of the individual circuits, other than, the gamma compensation circuit 30 and the LCD source driver 31 in FIG. 3, can be fetched to a common LCD source driver, so that an LCD source driver that includes a fast serial video interface can be implemented. Since for an XGA (Extended Graphics Array) (1024×768 dots) resolution the input clock frequency is approximately 2 GHz, it is preferable that a process, such as the SiGe (Silicon Germanium)-BiCMOS technology that is advocated by the present applicant (IBM), be employed. A detailed explanation of the SiGe-BiCMOS technology will not be given.

An explanation will now be given for serial transmission protocol according to this embodiment.

FIG. 4 is a diagram showing an example serial data format used for this embodiment. The serial data are prepared by the LCD controller 4, or by the preceding (upstream) source driver IC 20, and are transmitted to the cascade-connected source driver IC 20.

The serial data for this embodiment are carried by 28 bits, which, in this embodiment, is called a bit block. A bit block consists of a header 41, comprising four bits, and data 42, comprising twenty-four bits. In FIG. 4, in accordance with the header 41 the protocol for this embodiment defines four types of blocks, 44 to 47.

(1) Synchronization Bit Block 44

This is a bit block that is received during a blanking period. The header 41 is [1000], which represents a synchronization bit block, and the data 42 are all "0s." During this period, each source driver IC 20 acquires synchronization for the video data it receives.

(2) Command Bit Block 45

This is a bit block that is received in consonance with an arbitrary timing during the blanking period. The header 41, which represents a command bit block, is [1100]. Each source driver IC 20 (FIG. 1) interprets the control data contained in the data 42, and drives the liquid crystal cell 2. Example control data are as follows.

(a) Start of Transmission for Video Data

[0000-0000-0000-0000-0000-0000]

This command is used to provide notification that video data transmission has begun. After this command is issued, the transmission of video data using a data bit block, which will be described later, is initiated.

(b) Start of Transmission of Gamma Data

[1000-1000-1000-1000-1000-1000]This command is used to provide notification that the transmission of gamma compensation data (value for generating a reference voltage) has begun. After this command is issued, the transmission of gamma data using a data bit block, which will be described later, is initiated.

(c) Strobe ON/OFF

Strobe ON [1101-1101-1101-1101-1101-1101]

Strobe OFF [1100-1100-1100-1100-1100-1100]

These commands are used to provide notification that output to the liquid crystal cell 2 (FIG. 1) has begun. Upon the receipt of the command strobe ON, the driver controller 29 sets a strobe (STB) signal, which is to be transmitted to the LCD source driver 31, High. While upon the receipt of the command strobe OFF, the driver controller 29 sets a strobe (STB) signal, which is to be transmitted to the LCD source driver 31, Low. Thus, during a period wherein the strobe signal is High, the output to the liquid crystal cell 2 can be maintained in a high impedance state.

(d) Designation of Output Polarity

Positive polarity output [1111-1111-1111-1111-1111-1111]

Negative polarity output [1110-1110-1110-1110-1110-1110]

These commands are used to designate the polarity of a voltage output to the liquid crystal cell 2. Upon the receipt of one of these commands, the driver controller 29 (FIG. 3) will set or reset an internal polarity control signal (POL).

(3) Data Bit Block 46

This is a bit block used for the transmission of video data or of gamma compensation data. The header 41 is [1110] and represents a data bit block, while the contents of the block are identified by using a command that was previously transmitted.

(a) Video Data [Red 8-Bit] [Green 8-Bit] [Blue 8-Bit ]

The video data for one line are transmitted sequentially. For the XGA, 1024 data bit blocks 46 are sequentially received. The driver 29 for each source driver IC 20 (FIG. 1) receives only its own, individual data, and while it does this, it replaces the data bit block 46 with a wait bit block (which will be described later), and transmits the wait bit block to the succeeding source driver IC 20.

(b) Gamma Compensation Data [Gamma 10-Bit] [00000000000000]

This is a case where a reference gamma compensation voltage having a 10-bit precision is generated, for the gamma compensation the required number of data sets are transmitted. The drivers 29 of all the source driver ICs 20 may either receive the same data, or may receive different data.

(4) Wait Bit Block 47

This is used only by the source driver ICs 20 (FIG. 1). The header 41 is [1111] (wait) and represents a wait bit block. During the reception of video data, each source driver IC 20 transmits a wait bit block 47 to a succeeding source driver IC 20. During the reception of the wait bit block 47, the source driver IC 20 does not perform any process, and waits to receive the video data that is included in the data bit block 46.

Figure 5A:
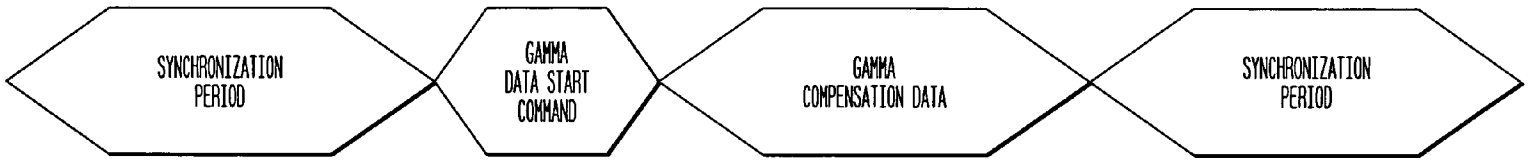
FIGS. 5A, 5B and 5C are diagrams showing the transmission of a serial signal that is formed of sequential bit blocks.
Figure 5B:
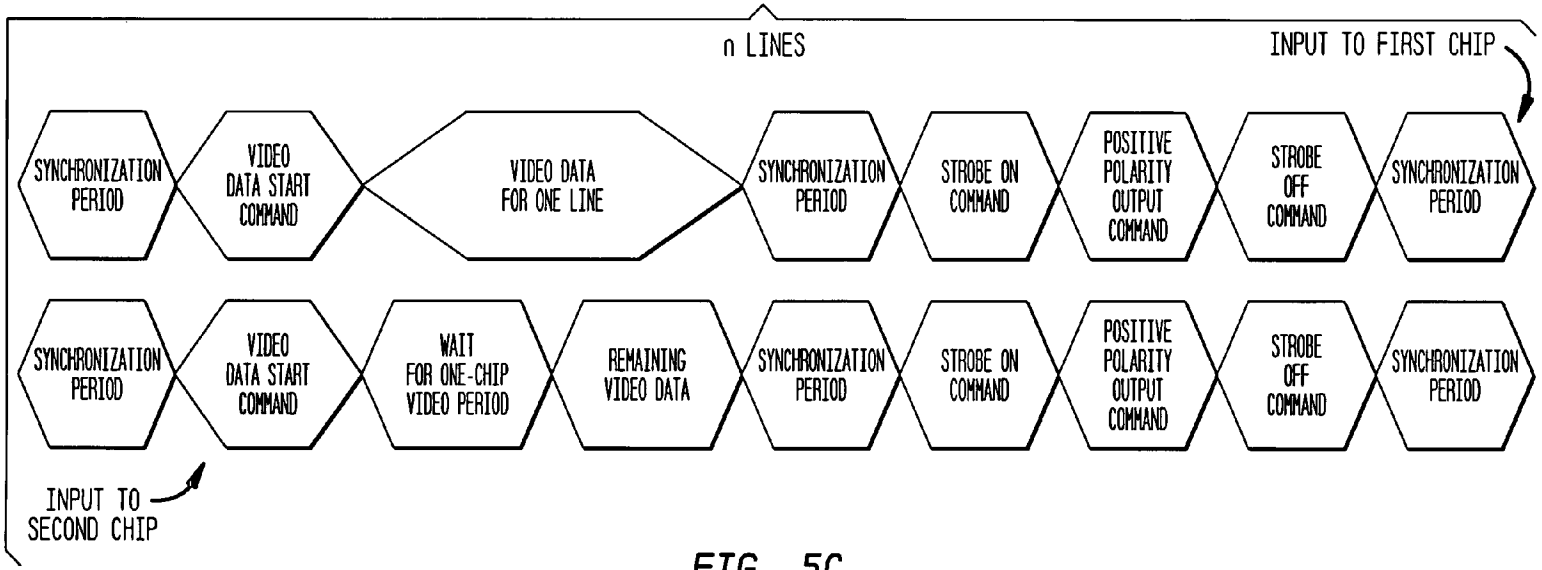
Figure 5C:
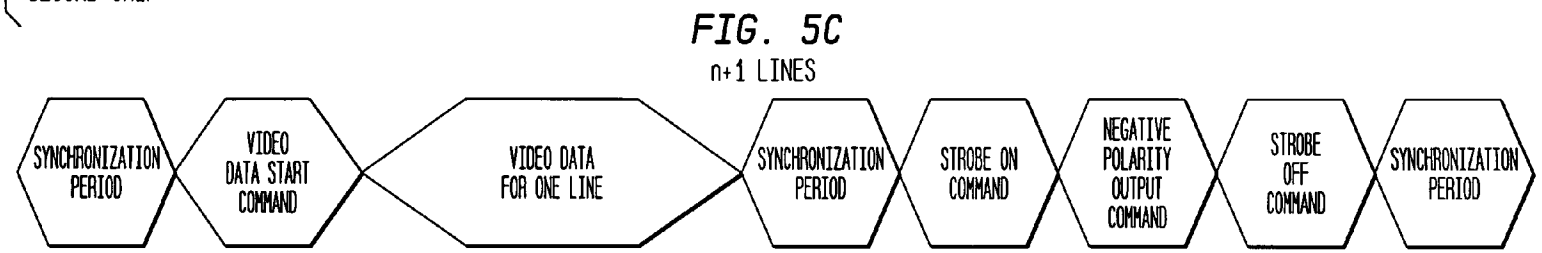

FIGS. 5A, 5B and 5C are diagrams showing the transmission of a serial signal that is composed of sequential bit blocks. In FIG. 5A, the initial state is shown where gamma compensation data for each source driver IC 20 is set. First, in a synchronization period (a Sync period) that is provided by a plurality of contiguous synchronization bit blocks 44, the source driver IC 20 obtains synchronization. Following which the gamma data transmission start command in the command bit block 45 is received, and then the gamma compensation data in the data bit block 46 is received. As previously described, the gamma compensation data consists of the required number of data bit blocks 46.

FIG. 5B is a diagram showing the transmission of n-line video data by using the input of a first chip that is the first source driver IC 20 and the input of a second chip that is the next source driver IC 20. After the blanking period (Sync: synchronization period), the video data transmission start command in the command bit block 45 is received, and then video data for one line is received. Subsequently, the strobe ON command is received at an appropriate time. At this time, the source driver IC 20 starts writing data to the liquid crystal cell 2 (FIG. 1). Actually, a voltage is applied to the liquid crystal cell 2 when the strobe OFF command is next received, and until that time, the output is maintained in a high impedance state. Positive output is selected by the output polarity designation command that is issued between the strobe ON command and the strobe OFF command. During the reception of its own, individual video data, the first chip in the upper portion in FIG. 5B transmits the wait bit block 47 to a succeeding source driver IC 20 (a second chip). The second chip in the lower portion skips the wait bit block 47, starts reception of the video data, and writes data to the liquid crystal cell 2.

FIG. 5C is a diagram showing the transmission of n+1 lines of video data. The difference from FIG. 5B is that negative output is selected as an output polarity.

As is described above, according to this embodiment, the four bit blocks are employed to transmit the video data and to control the source driver IC 20. As a result, all the not control input pins used for the conventional LCD source driver are required, and the WOA can be carried out.

Figure 6:
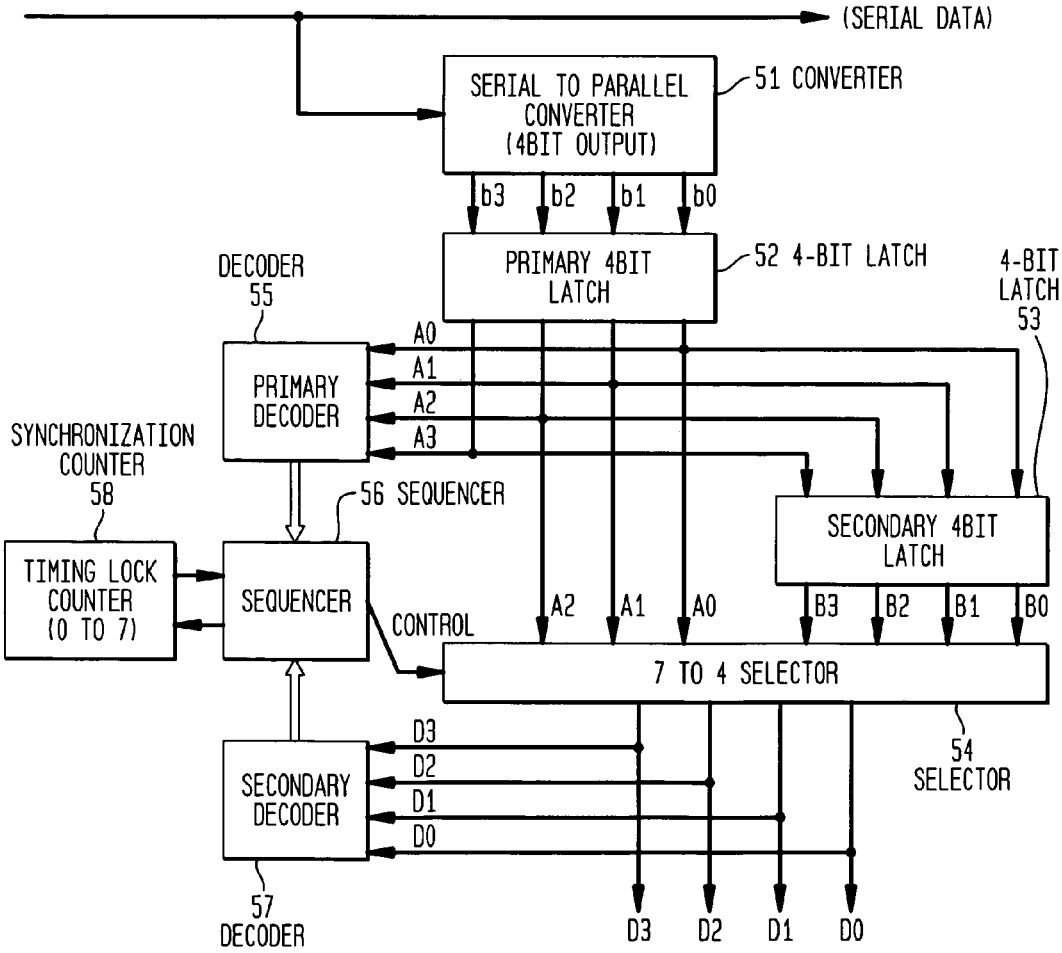
FIG. 6 is a diagram showing the arrangement of a serial video signal receiver 28.

The arrangement of the serial video signal receiver 28 in FIG. 3 will now be described. FIG. 6 is a diagram illustrating the arrangement of the serial video signal receiver 28. The serial video signal receiver 28 employs the synchronization bit block 44 in the received serial data to automatically obtain synchronization, and outputs four bits of parallel data whose heading has been adjusted. In FIG. 6, a converter 51 converts serial data into four bits of parallel data, and 4-bit latches 52 and 53 latch serial data output by the converter 51. A selector 54 selects four signals from among seven signals A0 to A2 and B0 to B3. A decoder 55 decodes the output of the 4-bit latch 52, and a sequencer 56 employs the output obtained by the decoder 55 to perform synchronization and to control the selector 54. A decoder 57 decodes the output of the selector 54. And a 3-bit synchronization counter 58 stores the header position of a bit block.

Figure 7:
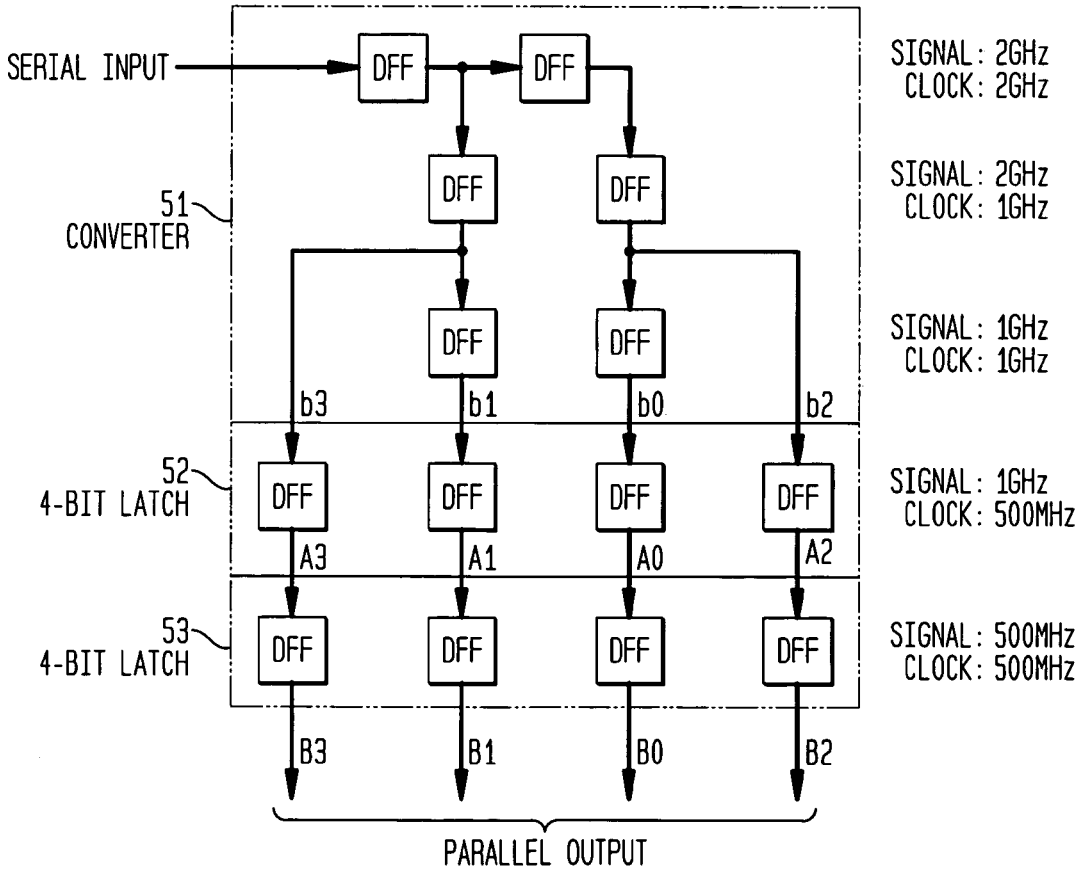
FIG. 7 is a diagram showing an example serial/parallel conversion function that employs a converter 51 and 4-bit latches 52 and 53.

The converter 51 and the 4-bit latches 52 and 53 convert serial data into parallel data having an eight bit width. This section is operated at the highest speed of all the constituent circuits of the source driver IC 20, and for this section a compact circuit is required. FIG. 7 is a diagram showing an example serial/parallel conversion function using the converter 51 and the 4-bit latches 52 and 53. This function is carried out by using D-FFs (D-flip-flops). In FIG. 7, Signal/Clock represents a signal and the operating frequency of a clock when the serial data are input at 2 GHz. The serial data received by the converter 51 are converted into parallel data, and a 1 GHz clock and data (a Signal) that can be sampled are output at 1 GHz. Then, the data are transmitted via the D-FFs of the 4-bit latches 52 and 53, and a 500 MHz clock and data (a Signal) that can be sampled are output at 500 MHz.

The decoder 55 in FIG. 6 decodes the output of the 4-bit latch 52, and searches for the header 41 of the synchronization bit block 44. The decoder 55 is constituted by four 4-bit comparators. FIG. 8 is a diagram showing the relationship between the comparison pattern for the header 41 and the output of the selector 54. The left column represents the output of the 4-bit latch 52 at an n clock; the middle column represents the output of the selector 54 at an n+1 clock; and the right column represents a control ID that is output by the sequencer 56 and transmitted to the selector 54. Upon the receipt of the control ID, the selector 54 outputs a signal in the middle column. Each comparator compares input [A3, A2, A1, A0] with a bit pattern in FIG. 8. Only during a period wherein asynchronization of data occurs, the sequencer 56 employs the results of the decoder 55 to control the selector 54, as is shown in FIG. 8, and to recover the data synchronization. The state of the selector 54, once it is set, is maintained until asynchronization of data occurs.

The decoder 57 is constituted by four 4-bit comparators, and decodes the output of the selector 54 to determine whether data synchronization has been maintained. FIG. 9 is a diagram showing patterns for conforming data synchronization. The patterns compared by the 4-bit comparator are, as is shown in FIG. 9, those of the headers 41 that consist of four types of bit blocks. The sequencer 56 monitors the comparison results at appropriate times, and recovers data synchronization if asynchronization has occurred. The asynchronization of data occurs when, for example, power is turned on or noise is superimposed on a serial signal line, or when video data is restarted. In this case, an incorrect bit sequence is extracted by the decoder 55 and the sequencer 56. In this embodiment, data synchronization can be confirmed by examining the output of the decoder 57, and data synchronization can be recovered if asynchronization occurs.

The synchronization counter 58 transmits a timing whereat the header 41 of a bit block is to be produced as the output of the selector 54. In this embodiment, since one bit block includes 28 bits, the header 41 is to be produced every seventh output of the selector 54. Therefore, during a period wherein data are synchronized (the sequencer 56 is notified), when the decoder 55 finds the header 41 of the synchronization bit block 44, the synchronization counter 58 is reset and then repetitively counts from 0 to 6, with the header 41 being produced as the output of the selector 54 when the synchronization counter 58 indicates 0. The sequencer 56 uses this timing to monitor the output of the decoder 57 to determine whether data synchronization has been obtained.

Figure 10:
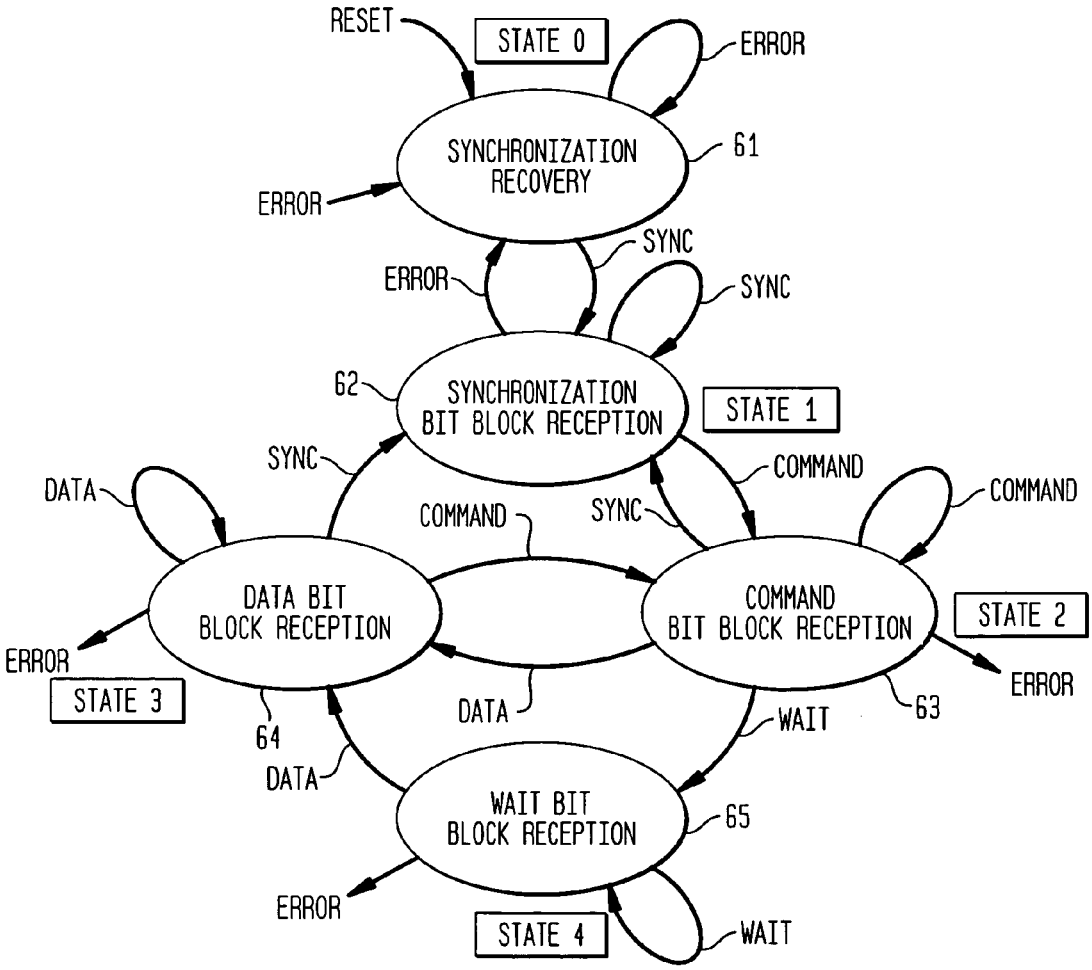
FIG. 10 is a diagram showing the shifting of the state of a sequencer 56.

FIG. 10 is a diagram showing the state shifting of the sequencer 56. The state shifting of the sequencer 56 occurs when the synchronization counter 58 indicates 0. First, when the system is reset, the sequencer 56 is in a "synchronization recovery" state 61. During this period, the selector 54 is controlled based on the results obtained by the decoder 55, and data synchronization and data tracking are automatically performed. When the header 41 of the synchronization bit block 44 is correctly detected by the decoder 57, the sequencer 56 is shifted to a "synchronization bit block reception" state 62. In this state, only the sequencer 56 receives the synchronization bit block 44, and no other process is performed. When the sequencer 56 receives the header command for the command bit block 45, the sequencer 56 is shifted to a "command bit block reception" state 63. If an undefined bit pattern is received, the sequencer 56 regards it as an error, and returns to the "synchronization recovery" state 61 to again obtain data synchronization. In the "command bit block reception" state 63, the sequencer 56 receives various control commands. In a "data bit block reception" state 64, the sequencer 56 receives video data or gamma compensation data. In a "wait bit block reception" state 65, the sequencer 56 waits for the reception of the data bit block 46. During this period, the source driver IC 20, which is located upstream of the target source driver IC 20, performs the sampling of video data. The target source driver IC 20 receives the data bit block 46 as well as the preceding wait bit block 47, and stores the block 46 in a video data memory (not shown) in the LCD source driver 31.

Figure 11:
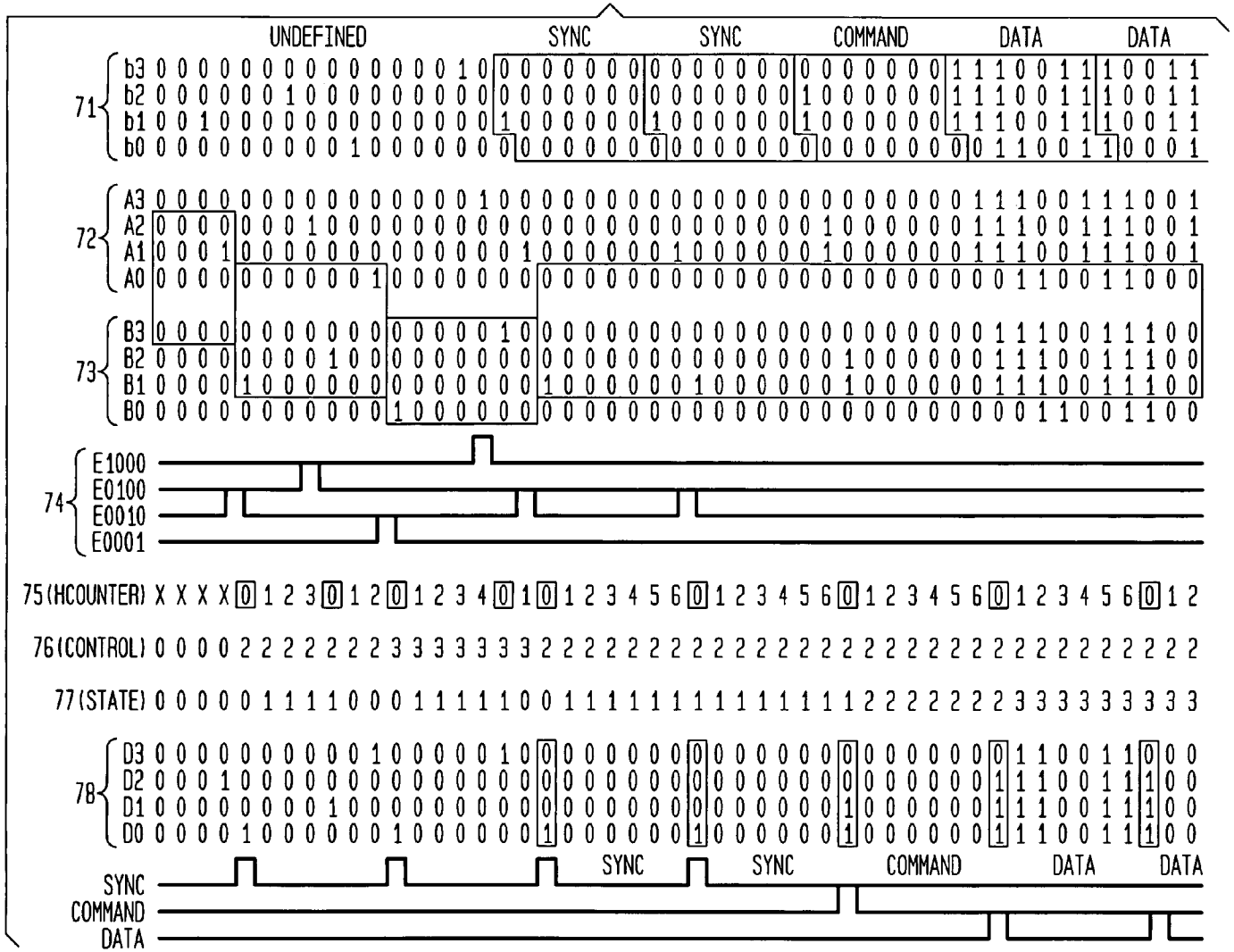
FIG. 11 is a diagram showing a process for data synchronization.

FIG. 11 is a diagram showing the operation performed by the serial video signal receiver 28 for data synchronization. In FIG. 11, bn (b3 to b0) 71 denotes the output of the converter 51, An (A3 to A0) 72 denotes the output of the 4-bit latch 52, and Bn (B3 to B0) 73 denotes the output of the 4-bit latch 53. Exxxx 74 denotes the results obtained by the decoder 55, and Sync, Command and Data denote results obtained by the decoder 57. Hcounter 75 denotes the value of the synchronization counter 58, and when this value is 0, the state of the sequencer 56 is shifted. Control 76 denotes a control signal for the selector 54, and functions as is shown in FIG. 8. State 77 denotes the state of the sequencer 56; 0 represents the "synchronization recovery" state 61, 1 represents the "synchronization bit block reception" state 62, 2 represents the "command bit block reception" state 63, and 3 represents the "data bit block reception" state 64, while Dn (D3 to D0) denotes the output of the selector 54. In FIG. 11 is shown the process during which the serial input is stabilized, following which Sync, Sync, Command, Data and Data are entered in the named order to obtain data synchronization. At least two cycles of Sync are required for data synchronization.

The arrangement of the driver controller 29 in FIG. 3 will now be described.

Figure 12:
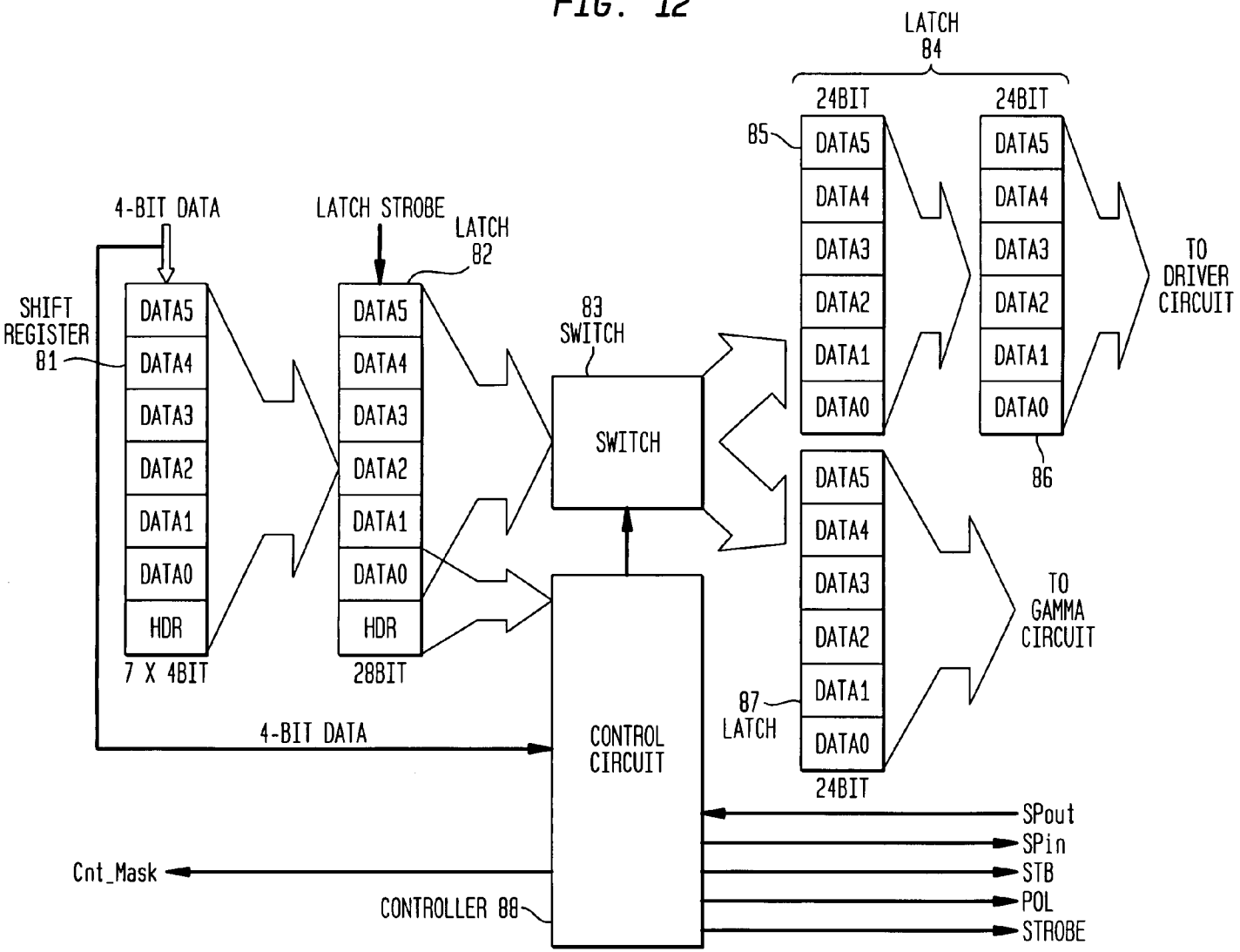
FIG. 12 is a diagram illustrating the arrangement of a driver controller 29.

FIG. 12 is a diagram illustrating the arrangement of the driver controller 29. As is shown in FIG. 12, the driver controller 29 employs a 4-bit, 7-level shift register 81 to convert the 4-bit parallel data, which are obtained by the serial video signal receiver 28, into 28-bit parallel data. In addition, the output of the shift register 81 is stored in a 28-bit latch 82 at a timing whereat the synchronization counter 58 in FIG. 6 indicates 0. The 24 bits of data stored in the latch 82 are stored in a 24-bit latch 84 or 87 by a switch 83, for which control is provided by a controller 88. The data stored in the latch 84 is a video signal, and is output to the LCD source driver 31 in FIG. 3. The latch 84 includes two stages: a latch 85 and a latch 86, the timing for which can be matched. The data stored in the latch 87 is gamma compensation data, and is output to the gamma compensation circuit 30 in FIG. 3. Control of the switch 83 is provided in accordance with whether a command that is received in advance is a command for starting the transmission of video data or for starting the transmission of gamma data.

In accordance with a received command, the controller 88 generates and transmits a control signal to the LCD source driver 31 that, in FIG. 12, includes SPin, a sampling start pulse that is generated at the timing at which video data are received; STB, a signal for controlling the output to the liquid crystal cell 2, which upon the receipt of a strobe ON command is output High and which upon the receipt of a strobe OFF command is output Low; and POL, a signal for controlling the polarity of the output to the liquid crystal cell 2, which upon the receipt of a positive polarity output command is output High and which upon the receipt of a negative polarity output command is output Low. The controller 88 also receives from the LCD source driver 31 a signal SPout, which provides notification of the time at which the sampling of video data for one chip ended. Thereafter the controller 88 employs the signal Spout and the 4-bit data received from the serial video signal receiver 28 to generate a Cnt_Mask, which is a signal for generating the wait bit block 47. A Strobe signal is also output by the controller 88 to notify the gamma compensation circuit 30 in FIG. 3 of the reception of gamma compensation data.

Figure 13A:
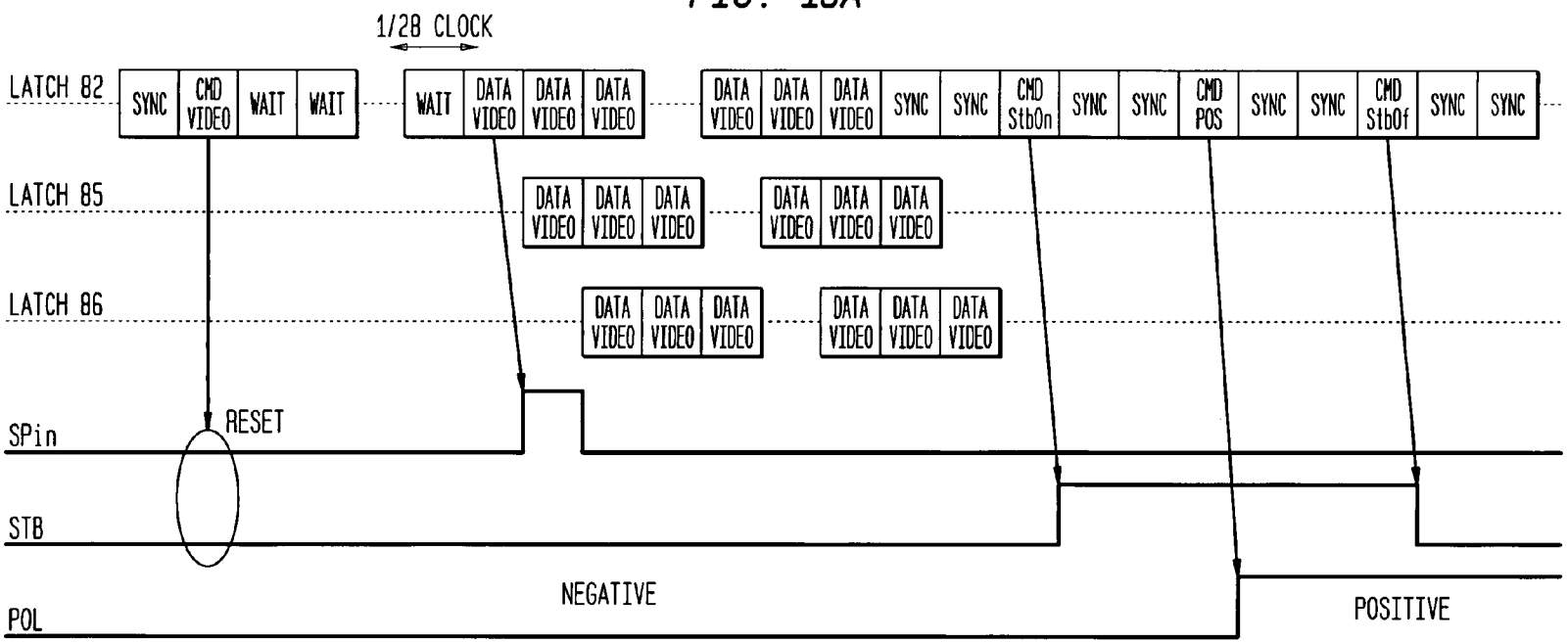
FIGS. 13A and 13B are diagrams showing the condition for generating a control signal (waveforms and the shifting of the state of each control signal).
Figure 13B:
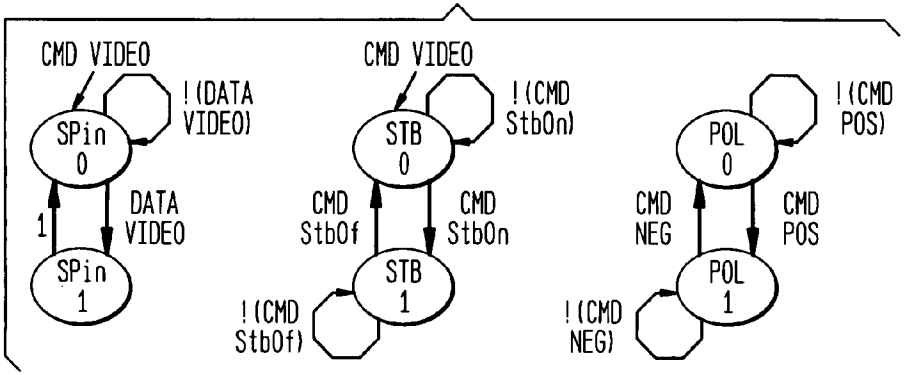

FIGS. 13*a* and 13*b* are diagrams showing the process for generating a control signal (waveforms and the shifting of the state of each control signal). In FIG. 13A, latch 82 represents the output of the latch 82 in FIG. 12, and the latches 85 and 86 represent the video data that are latched and that, via the switch 83, are output to the LCD source driver 31. As is shown in FIG. 13B, when the first video data is received following the issue of the video data transmission start command (Cmd Video), the one pulse signal SPin is output. That is, the state is shifted from 0 to 1. Also, the signal STB is set to 1 upon the receipt of a strobe ON command (Cmd StbOn), and is cleared upon the receipt of a strobe OFF command (Cmd StbOf). In addition, upon the receipt of the output polarity designation command (Cmd Pos/Cmd Neg), the signal POL is shifted to a bit that represents the designated polarity. In this embodiment, the controller 88 is operated at $1/28$ of the input clock.

Figure 14:
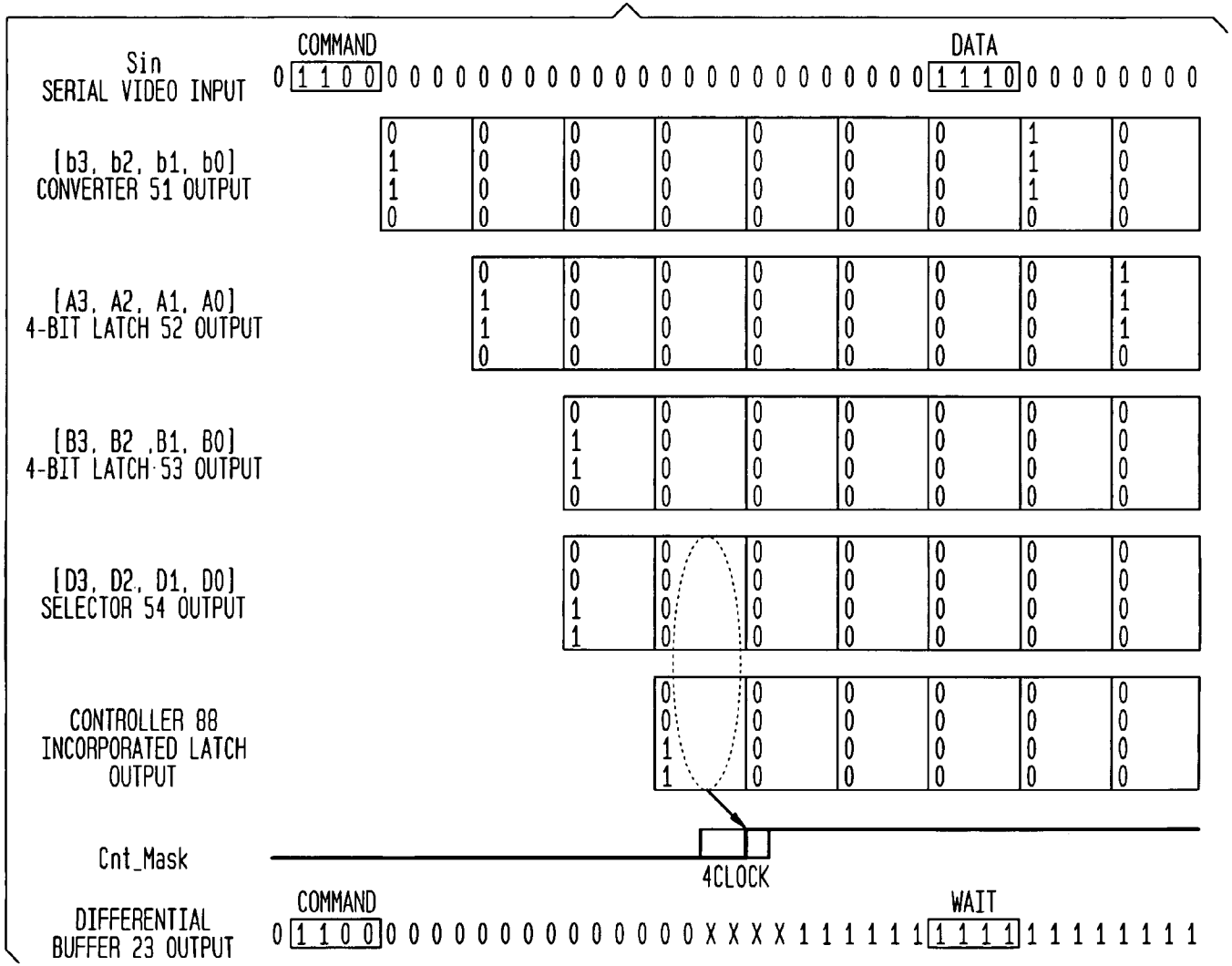
FIG. 14 is a diagram showing the transmission of data when generation of a wait bit block 47 is begun.

FIGS. 14 to 18 are diagrams showing the distribution of video data that is effected by the generation of the wait bit block 47. FIG. 14 is a diagram showing the transmission of data when the generation of the wait bit block 47 is initiated. All the source driver ICs 20 perform the same operation. The serial video data are transmitted via the converter 51, the 4-bit latches 52 and 53 and the selector 54 in FIG. 6 to the controller 88 in FIG. 12. The serial video signal is a signal of about 2 GHz, and the others are signals of about 500 MHz that is ¼ of 2 GHz. At the timing at which the selector 54 outputs the header 41 of the bit block (the timing whereat the synchronization counter 58 in FIG. 6 outputs 0), the controller 88 is notified that the input bit block is the command bit block 45, and at the next 500 MHz clock it is notified of that the command is the video data transmission start command. At this time, because of the timing for the self-operating converter 51, a variance of four 2 GHz clocks occurs at a Cnt_Mask change point whereat the Cnt_Mask is set to 1. However, since there is still extra time remaining before the header 41 for the data bit block 46 succeeding the command bit block 45 is received, header [1110] can be changed to [1111], i.e., the data bit block 46 can be changed to the wait bit block 47. In addition, although the output of the differential buffer 23 may become unstable when Cnt_Mask is changed from 0 to 1, originally this period is not meaningful as far as the succeeding source driver IC 20 is concerned, and no problem occurs.

Figure 15:
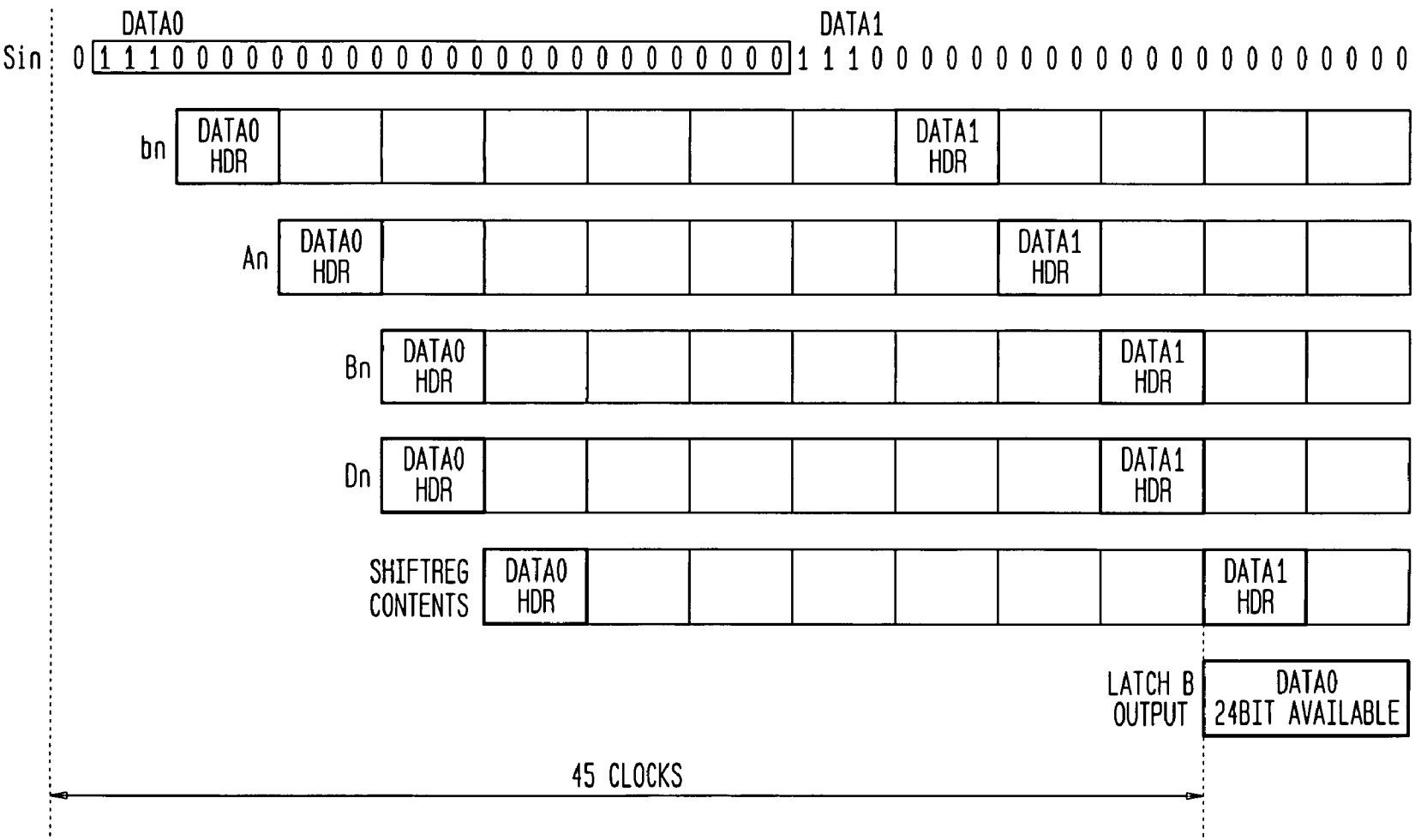
FIG. 15 is a diagram showing a delay extending from the input of serial video data to the completion of 24-bit data.
Figure 16:
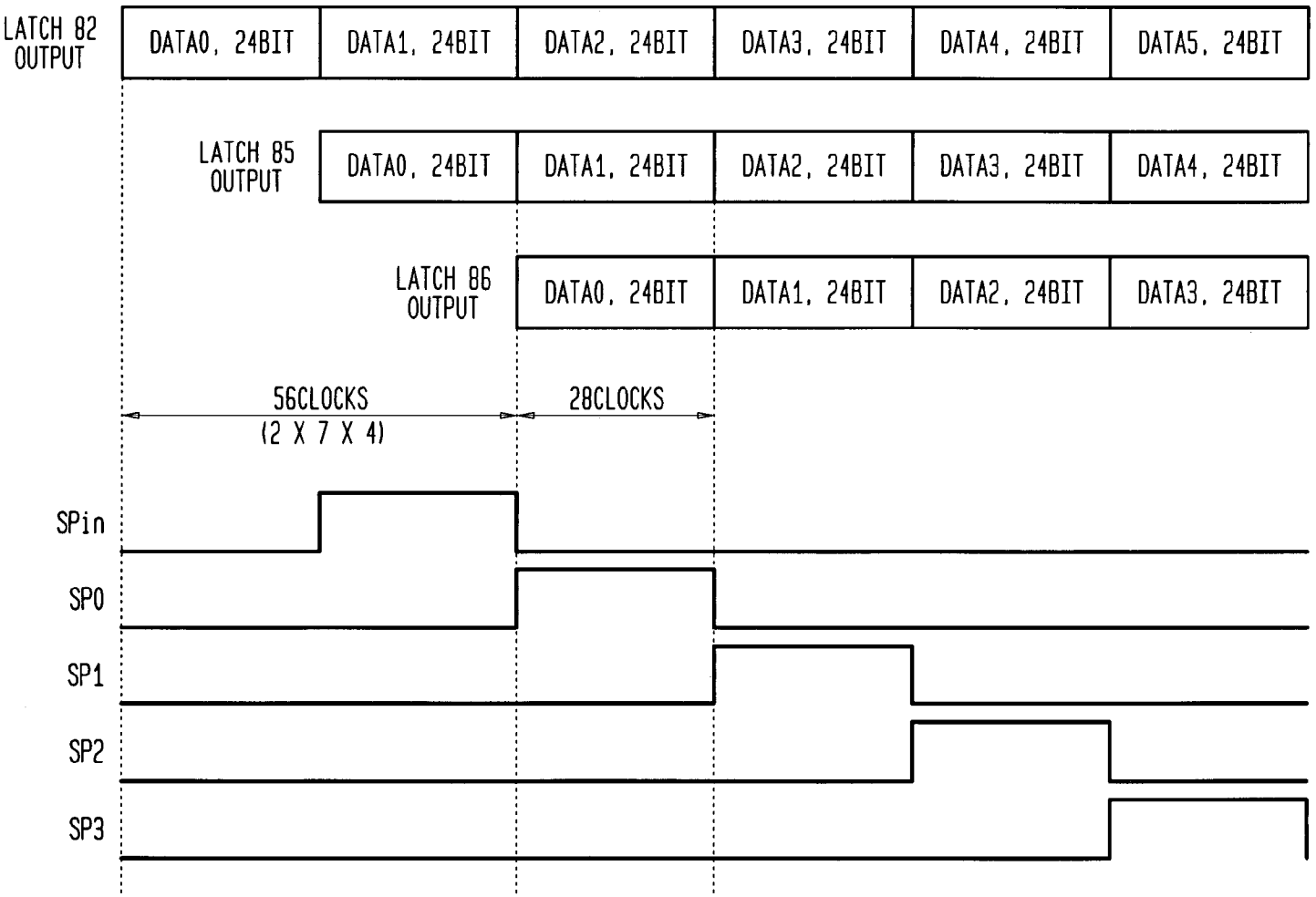
FIG. 16 is a diagram showing the timings for data output to an LCD source driver 31 and for a sampling pulse.
Figure 17:
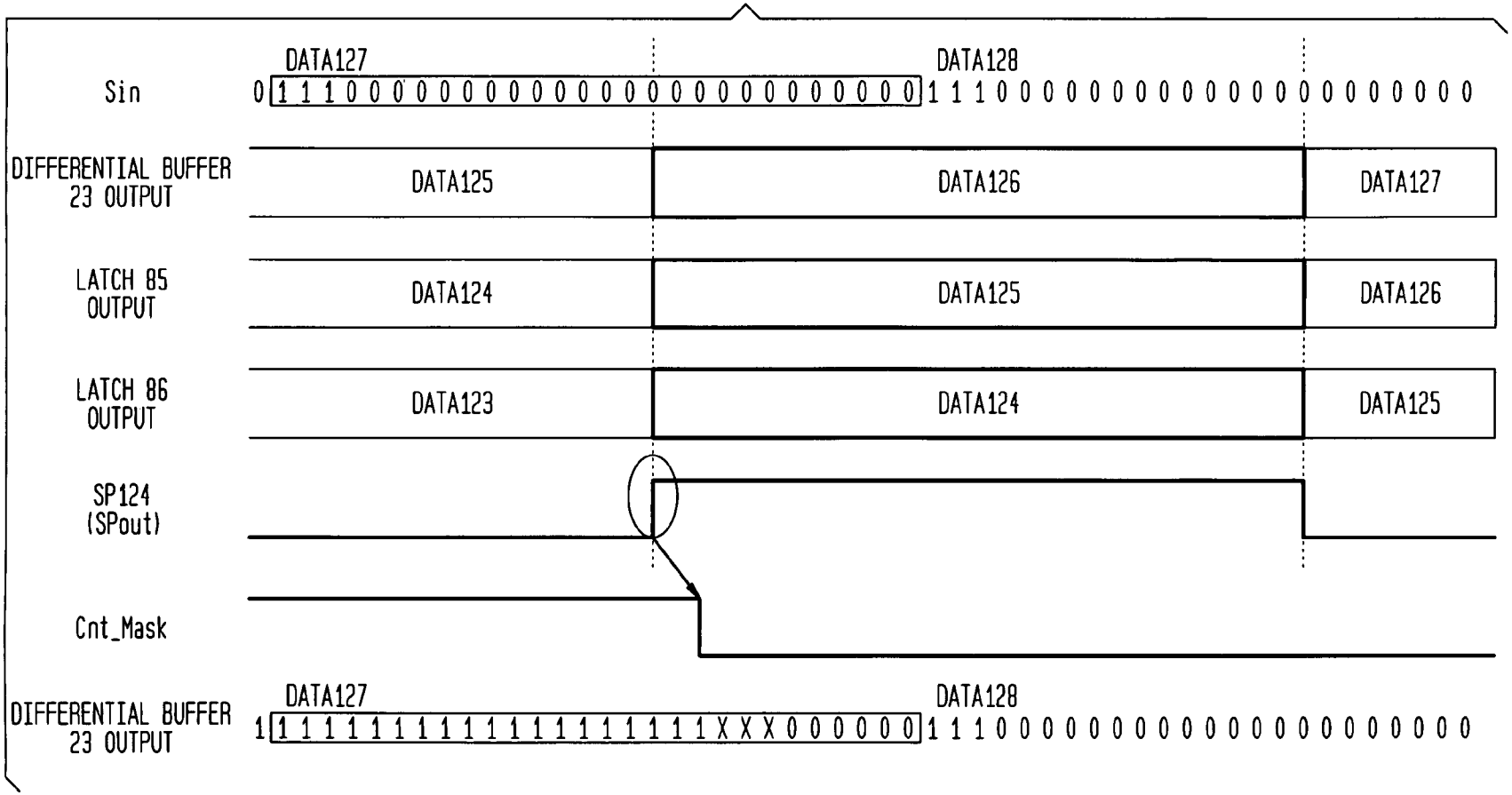
FIG. 17 is a diagram showing the timing whereat data are distributed among source driver ICs 20.

FIG. 15 is a diagram showing a delay that extends from the time serial video data are entered until the 24-bit data are completed. In FIG. 15, a delay is shown that continues until the 24-bit data are obtained by the latch 82 in FIG. 12. FIG. 16 is a diagram showing the timings for the data output to the LCD source driver 31 and for a sampling pulse. In FIG. 16, the 24-bit data for the latch 82 are transmitted via the latches 85 and 86 in FIG. 12 to the LCD source driver 31 in FIG. 3. SPin is a sampling start pulse, and SPn (SP0, SP1, SP2, SP3, . . . ) is the output of the shift register that is incorporated in the LCD source driver 31. When SPn is 1, the n-th data are stored. FIG. 17 is a diagram showing the timing whereat the data are distributed among the source driver ICs 20 in accordance with FIGS. 15 and 16. In FIG. 17 a source driver IC 20 of 384 output pins (128×3 (RGB)) is employed. Each driver chip requires 128 data bit blocks 46. The first source driver IC 20 reads Data 0 to Data 127, and the second source driver IC 20 reads Data 128 to Data 255. As is apparent from FIG. 17, the controller 88 in FIG. 12 employs, as SPout, the SP124 representing the timing for storing Data 124 to return Cnt_Mask to 0 at an appropriate timing. When Cnt_Mask has been returned to 0, the serial video signal that represents the wait bit block 47 is changed to the original data bit block 46, so that the succeeding source driver IC 20 can correctly receive the video data.

Figure 18:
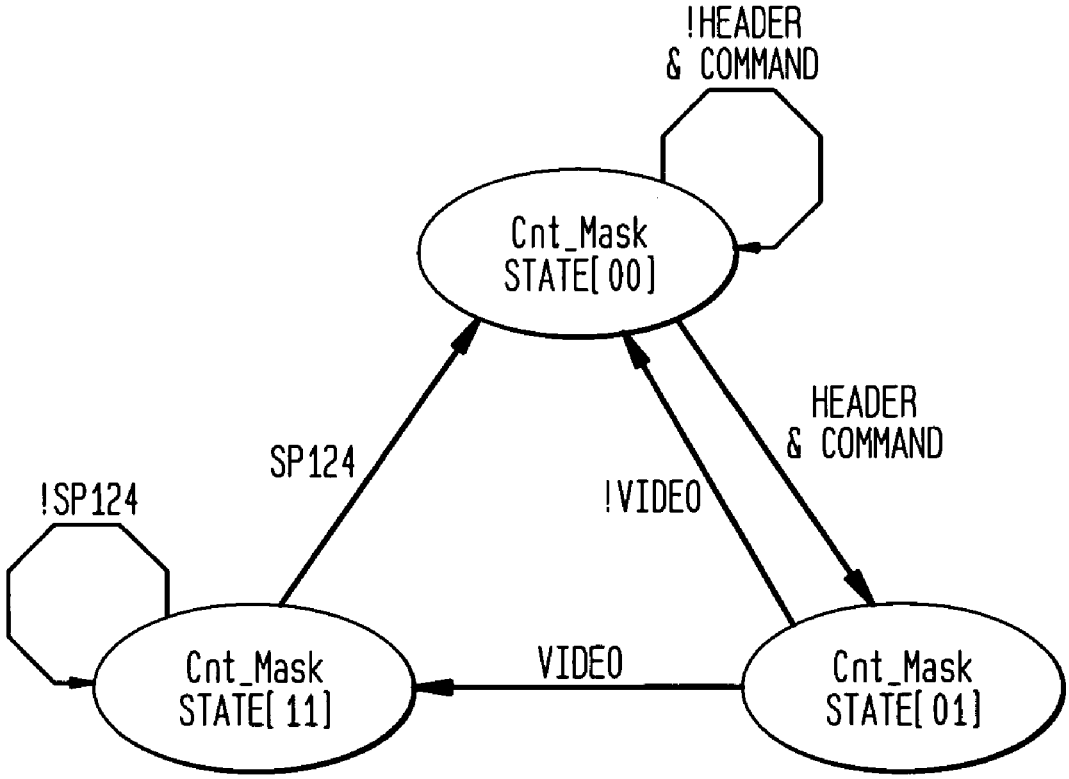
FIG. 18 is a diagram showing the sequence for the generation of a Cnt_Mask signal.

As is described above, since the Cnt_Mask signal is controlled, video data can be correctly distributed among the source driver ICs 20 that are cascade-connected. FIG. 18 is a diagram showing the sequence for generating a Cnt_Mask signal. The state is shifted each ¼ clock (500 MHz in this embodiment). The Cnt_Mask signal is set to 1 in State[11], and is set to 0 in the other States.

Figure 19:
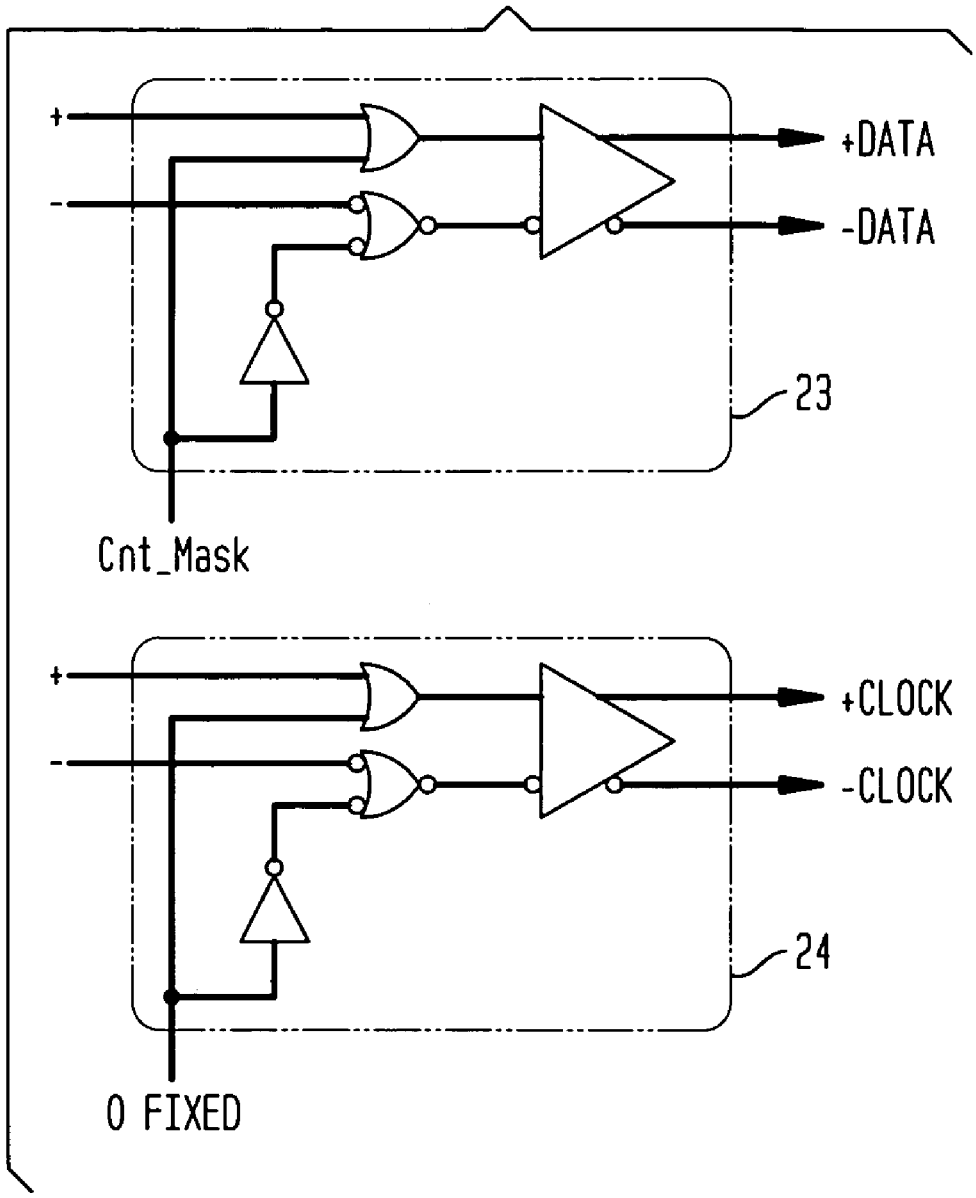
FIG. 19 is a diagram showing the arrangements of the output differential buffers 23 and 24 in FIG. 3.
Figure 20:
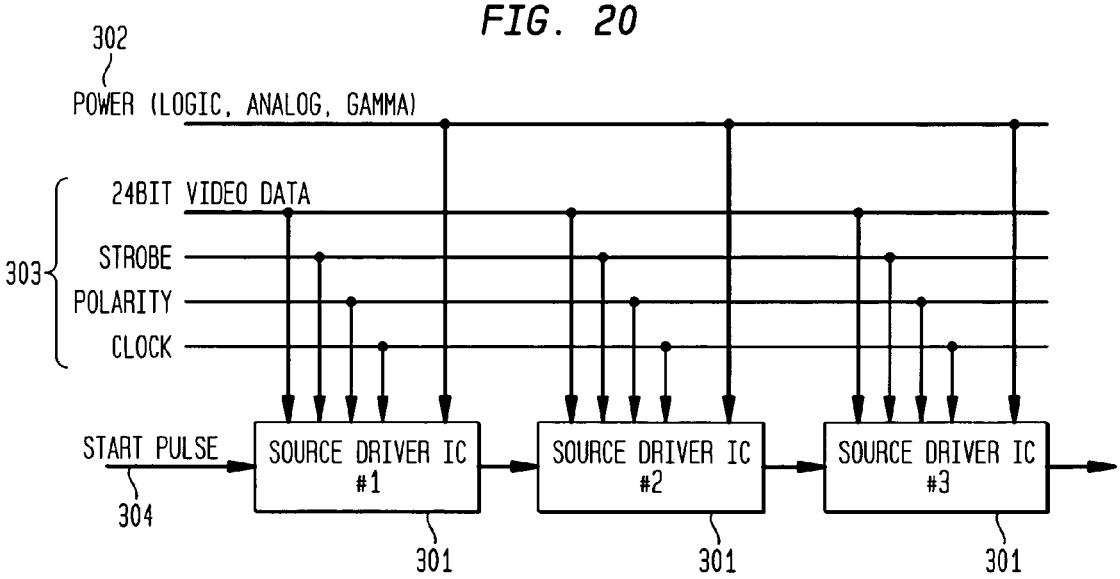
FIG. 20 is a diagram for explaining an interface used by a conventional LCD source driver.

FIG. 19 is a diagram showing the arrangements of the output differential buffers 23 and 24 in FIG. 3. In FIG. 19, when Cnt_Mask signal is 1, the positive output (+Data) of the differential buffer 23 for video data is set to 1, and the negative output (−Data) is set to 0. The differential buffer 24 for a clock has the same arrangement in order to match its characteristic with that of the video data differential buffer 23, and the control input is fixed at 0.

As is described above, in this embodiment, the signal pad and the power pad are arranged on both sides of the source driver IC 20, which is a chip, and all the lines among the chips are cascade-connected. Further, the power source is also cascade-connected by including a metal layer inside the chips. As a result, the bus connection for the chips can be eliminated, and the WOA can be provided.

Further, a synchronization pattern of two cycles is transmitted during the horizontal blanking period for a video signal. And during a transmission period for video data, the header pattern for each bit block is monitored to confirm with the synchronization of data. Therefore, even when an erroneous operation occurs, the synchronization of data can be recovered after one line.

In addition, by the transmission of a packet, each source driver IC 20 can control the operation merely by using a video transmission line. As a result, the control input terminals that are normally prepared are not required, and the number of lines can be considerably reduced.

Furthermore, since each source driver IC 20 masks its own video data, video data can be distributed among the chips while the video data belonging to a source driver IC 20 are not revealed to a succeeding driver. Thus, the distribution of video data can also be performed merely by video data transmission lines.

As is described above, according to the present invention, it is possible to reduce the number of inputs to an LCD driver, and to reduce manufacturing costs by employing the COG&WOA technique.

Further, a compact, fast serial interface requiring only a small amount of power can be provided and the number of circuits that are operated at a high speed can be minimized, so that increases in power consumption and in chip sizes can be suppressed.

While the invention has been particularly shown and described with respect to preferred embodiments thereof, it will be understood by those skilled in the art that the foregoing and other changes in form and details may be made therein without departing form the spirit and scope of the invention.

Having thus described our invention, what we claim as new, and desire to secure by Letters Patent is:

1. A liquid crystal display device comprising:

a liquid crystal cell which forms an image display area on a substrate; and a driver for applying a voltage to said liquid crystal cell based on an input video signal, wherein said driver includes a plurality of driver ICs that are mounted on said substrate and a plurality of signal lines, each of the signal lines passing through each of the driver ICs in series, wherein said driver ICs are cascade-connected in series using said signal lines, and wherein the driver receives a digital packet signal including said input video signal and each driver IC includes a controller for generating a mask signal to mask video data output from the driver IC and for transmitting a wait bit block to a succeeding driver IC in said series; and wherein said plurality of driver ICs are cascade-connected to a power feed line via a metal layer inside of each of said driver ICs; and wherein:

during reception of video data, each driver IC transmits the wait bit block to said succeeding driver IC; and during reception of the wait bit block, said succeeding driver IC does not process any video data and waits to receive video data from said each driver IC.

2. The liquid crystal display device according to claim 1, wherein said driver ICs receive video signal consisting of serial data, and wherein said video signal is synchronized based on a synchronization pattern included in said serial data.

3. A liquid crystal display device comprising:

a liquid crystal cell which forms an image display area on a substrate; and a driver for distributing an input video signal to a plurality of driver ICs chain connected in series using a plurality of signal lines, each of the signal lines passing through each of the driver ICs in series, and for applying a voltage to said liquid crystal cell by employing said driver ICs, wherein said driver receives a digital packet signal including said input video signal and distributes said video signal to said plurality of driver ICs, and each driver IC includes a controller for providing a masking signal to mask the video signal output by said driver IC and for transmitting a wait bit block to a succeeding driver IC in said series; and wherein:

during reception of video data, each driver IC transmits the wait bit block to said succeeding driver IC; and during reception of the wait bit block, said succeeding driver IC does not process any video data and waits to receive video data from said each driver IC.

4. The liquid crystal display device according to claim 3, wherein said downstream driver IC of said driver applies a voltage to said liquid crystal cell in accordance with said input video signal after receiving said masking signal from said upstream driver IC.

5. A liquid crystal display device comprising:

a liquid crystal cell which forms an image display area on a substrate; and a driver for distributing an input video signal to a plurality of driver ICs that are cascade-connected, and for applying a voltage to said liquid crystal cell by employing said driver ICs, wherein said plurality of driver ICs of said driver are cascade-connected in series by a video transmission line provided on said substrate, said video transmission line passing through each of the driver ICs in series, and are controlled by serial data that are transmitted along said video transmission line, and wherein the driver receives a digital packet signal including said input video signal and each driver IC includes a controller for generating a mask signal to mask the serial data output from the driver IC and for transmitting a wait bit block to a succeeding driver IC in said series; and wherein said driver further comprises a clock line and a power line which make a cascade connection to said plurality of driver ICs via a metal layer inside of each of said driver ICs; and wherein:

during reception of video data, each driver IC transmits the wait bit block to said succeeding driver IC; and during reception of the wait bit block, said succeeding driver IC does not process any video data and waits to receive video data from said each driver IC.

6. The liquid crystal display device according to claim 5, wherein said video transmission line connecting said plurality of driver ICs comprises a first signal line, and a second signal line for which the polarity of said first signal line has been inverted.

7. The liquid crystal display device according to claim 5, wherein, of said driver ICs, an upstream driver IC includes a dummy circuit for substantially matching a video phase and a clock phase.

8. A liquid crystal controller comprising:

a receiver for receiving a video signal from a host to display an image;

a sequencer for, upon the receipt of a control signal from said host, generating header information, based on a table, for packet data that are to be output to an LCD driver comprising a plurality of driver ICs and a video transmission line passing through each of the driver ICs in series, wherein said driver ICs are cascade-connected in series via a metal layer inside of each of said drive ICs; and output means for converting said video signal received from said receiver into a serial video signal, for adding said header information generated by said sequencer to said serial video signal to form a digital packet signal including said serial video signal, and for outputting the resultant packet signal to the ICs of said LCD driver; and wherein each driver IC includes a controller for generating a mask signal to mask the serial video signal output from the driver IC and for transmitting a wait bit block to a succeeding driver IC in said series; and wherein:

during reception of video data, each driver IC transmits the wait bit block to said succeeding driver IC; and during reception of the wait bit block, said succeeding driver IC does not process any video data and waits to receive video data from said each driver IC.

9. A liquid crystal controller comprising:

a receiver for receiving a video signal from a host to display an image;

a sequencer for, upon the receipt of a control signal from said host, generating header information for packet data that are to be output to an LCD driver comprising a plurality of driver ICs and a video transmission line passing through each of the driver ICs in series, wherein said driver ICs are cascade-connected in series; and output means for converting said video signal received from said receiver into a serial video signal, for adding said header information generated by said sequencer to said serial video signal to form a digital packet signal including said serial video signal, and for outputting the resultant packet signal to the ICs of said LCD driver; and wherein each driver IC includes a controller for generating a mask signal to mask the serial video signal output from the driver IC; and wherein said sequencer generates said header information by which said driver ICs of said LCD driver are synchronized with each other, and wherein said output means provide said header information used for synchronization during a horizontal blanking period.

10. A video signal transmission method, for transmitting a video signal to an LCD driver which has a plurality of driver ICs and a video transmission line, comprising the steps of:

transmitting a digital packet signal including a video signal, including a horizontal blanking period, to said driver ICs in series via a serial interface wherein the video transmission line passes through each of the driver ICs in series, and the driver ICs are cascade connected in series by said via a metal layer inside of each of said driver ICs;

transmitting a synchronization pattern during said horizontal blanking period in order to synchronize said video signal for said driver ICs; and each driver IC selectively generating a mask signal to mask the video signal output from the driver IC and transmitting a wait bit block to a succeeding drier IC in said series; and wherein:

during reception of video data, each driver IC transmitting the wait bit block to said succeeding driver IC; and during reception of the wait bit block, said succeeding driver IC not process any video data and waits to receive video data from said each driver IC.

11. A video signal transmission method, for transmitting a video signal to an LCD driver which has a plurality of driver ICs and a video transmission line, comprising the steps of:

transmitting a digital packet signal including a video signal, including a horizontal blanking period, to said driver ICs in series via a serial interface wherein the video transmission line passes through each of the driver ICs in series, and the driver ICs are cascade connected in series by said video transmission line;

transmitting a synchronization pattern during said horizontal blanking period in order to synchronize said video signal for said driver ICs; and each driver IC selectively generating a mask signal to mask the video signal output from the driver IC; and wherein said synchronization pattern is transmitted for at least at two cycles, and wherein, during the period in which said video signal is transmitted, said driver ICs conform to said synchronization pattern.

12. A video signal transmission method, for transmitting a video signal to an LCD driver which has a plurality of driver ICs that are cascade-connected, comprising the steps of:

transmitting a digital packet signal including a video signal via a serial interface to said driver ICs that are cascade-connected in series by a video transmission line passing through each of the driver ICs in series;

applying to an LCD a voltage based on said video signal that is received and that is to be processed by each of said driver ICs; and each driver IC selectively generating a mask signal to mask the video signal output from the driver IC; and wherein said video signal is constituted by bit blocks having a plurality of attributes and wherein said driver ICs are controlled by using said bit blocks; and wherein one of said bit blocks includes a wait command for waiting for said driver ICs, and wherein said wait command is generated by each of said driver ICs that processes said video signal, and is transmitted to a downstream driver IC that is cascade-connected.

13. A video signal transmission method for transmitting a video signal to an LCD driver which has a plurality of driver Ics that are cascade-connected via a metal layer inside of each of said driver ICs, comprising the steps of:

transmitting a digital packet signal including a video signal via a serial interface to said driver ICs that are cascade-connected in series by a video transmission line passing through each of the driver ICs in series, applying to an LCD a voltage based on said video signal that is received and that is to be processed by each of said driver ICs;

each driver IC selectively generating a mask signal to mask the video signal output from the driver IC and transmitting a wait bit block to a succeeding driver IC in said series;

wherein said video signal is constituted by bit blocks having a plurality of attributes and wherein said driver ICs are controlled by using said bit blocks; and wherein said video signal is transmitted to said LCD driver by using a packet, and wherein said plurality of driver ICs are controlled by a protocol that employs the header of said packet.

* * * * *